US005322758A

United States Patent [19]

Texter et al.

[11] Patent Number: 5,322,758

[45] Date of Patent: Jun. 21, 1994

[54] INTEGRAL COLOR DIFFUSION TRANSFER ELEMENT FOR LARGE VOLUME DEVELOPMENT

[75] Inventors: John Texter, Rochester; Wayne A. Bowman, Walworth; Glenn T. Pearce, Fairport; Douglas E. Corbin, Rochester, all of N.Y.

[73] Assignee: Eastman Kodak Company, Rochester, N.Y.

[21] Appl. No.: 952,556

[22] Filed: Sep. 28, 1992

[51] Int. Cl.[5] ..... G03C 8/00; G03C 1/46; G03C 1/76; G03C 1/08

[52] U.S. Cl. ..... 430/213; 430/214; 430/215; 430/226; 430/505; 430/536; 430/543

[58] Field of Search ..... 430/213, 214, 215, 226, 430/376, 380, 390, 505, 512, 536, 543

[56] References Cited

U.S. PATENT DOCUMENTS

| | | | |
|---|---|---|---|
| 3,227,550 | 1/1966 | Whitmore et al. | 96/3 |
| 3,477,849 | 11/1969 | Becker | 96/29 |
| 3,493,939 | 5/1969 | Bloom et al. | 430/242 |
| 3,498,785 | 3/1970 | Bloom et al. | 96/3 |
| 3,734,726 | 5/1973 | Figueras et al. | 96/3 |
| 3,743,504 | 7/1973 | Dappen et al. | 96/3 |
| 3,885,969 | 5/1975 | Kruck | 96/84 R |
| 3,888,669 | 6/1975 | Cardone | 430/214 |
| 3,928,312 | 12/1975 | Fleckenstein | 260/156 |
| 4,055,429 | 10/1977 | Holmes et al. | 96/74 |
| 4,056,394 | 11/1977 | Hannie | 96/29 D |
| 4,060,417 | 11/1977 | Cieciuch et al. | 96/3 |
| 4,076,529 | 2/1978 | Fleckenstein et al. | 96/3 |
| 4,088,499 | 5/1978 | Brust et al. | 96/29 D |
| 4,141,730 | 2/1979 | Minagawa et al. | 96/9 |
| 4,202,694 | 5/1980 | Taylor | 430/215 |
| 4,317,892 | 3/1982 | Abel | 525/194 |
| 4,401,746 | 8/1983 | Pfingston | 430/215 |
| 4,407,929 | 10/1983 | Boie et al. | 430/220 |
| 4,429,033 | 1/1984 | Boie et al. | 430/237 |
| 4,450,224 | 5/1984 | Klein et al. | 430/213 |
| 4,459,346 | 7/1984 | Bishop et al. | 430/215 |
| 4,481,277 | 11/1984 | Pfingston | 430/214 |

(List continued on next page.)

FOREIGN PATENT DOCUMENTS

| | | |
|---|---|---|
| 0144059B1 | 2/1989 | European Pat. Off. . |
| 0115303B1 | 10/1989 | European Pat. Off. . |
| 0461416 | 12/1991 | European Pat. Off. . |
| 2423733 | 12/1974 | Fed. Rep. of Germany . |
| WO91/15526 | 10/1991 | PCT Int'l Appl. . |

OTHER PUBLICATIONS

Research Disclosure, 19551, Jul. 1980, pp. 301-310.
Research Disclosure, vol. 194, No. 21, Jun. 1980, pp. 234-236.

*Primary Examiner*—Charles L. Bowers, Jr.
*Assistant Examiner*—J. Pasterczyk
*Attorney, Agent, or Firm*—Paul A. Leipold

[57] ABSTRACT

In accordance with this invention a photographic color diffusion transfer element is provided wherein said element comprises a single dimensionally stable transparent support and coated thereon in reactive association and in sequence (1) a mordant layer for binding diffusible dyes, (2) a light reflecting layer, (3) imaging layers comprising a radiation sensitive layer comprising silver halide and a diffusible dye forming layer comprising a diffusible dye forming compound, and (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound. In another preferred embodiment, the sequential arrangement of layers next to the support is in the order: (1) imaging layers comprising a radiation sensitive layer comprising silver halide and a diffusible dye forming layer comprising a diffusible dye forming compound, ( 2) a light reflecting layer, (3) a mordant layer for binding diffusible dyes, (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound.

32 Claims, No Drawings

U.S. PATENT DOCUMENTS 4,485,165 11/1984 Finn et al. ..... 430/223
4,504,569 3/1985 Abel et al. ..... 430/214
4,508,809 4/1985 Boie et al. ..... 430/237
4,519,689 5/1985 Kinsman et al. ..... 354/304
4,615,421 10/1971 Land ..... 96/3
4,636,455 1/1987 Aono et al. ..... 430/203
4,649,095 3/1987 Takahashi et al. ..... 430/214
4,680,247 7/1987 Murphy ..... 430/215
4,749,643 6/1988 Öhlschläger ..... 430/931
4,774,162 9/1988 Shibata et al. ..... 430/213
4,865,946 9/1989 Bowman et al. ..... 430/215
5,023,162 6/1991 Yamanouchi et al. ..... 430/203
5,122,720 5/1992 Karino ..... 430/213

INTEGRAL COLOR DIFFUSION TRANSFER ELEMENT FOR LARGE VOLUME DEVELOPMENT

FIELD OF THE INVENTION

This invention relates to photographic imaging systems that utilize silver halide based radiation sensitive layers and associated formation of image dyes in a wet development process and to systems which utilize polymeric barrier layers to control diffusion of particular components. In particular, this invention relates to such systems where the resulting dyes, when the photographic elements are substantially wet, have substantial solubility and freedom to diffuse. More particularly, this invention relates to color diffusion transfer systems that utilize large volume development processing baths.

BACKGROUND OF THE INVENTION

Conventional Wet Silver Halide Processes

In conventional wet processing of silver halide based color photographic elements, an imagewise exposed element, for example color paper designed to provide color prints, is processed in a large volume of color developer solution. The element is typically immersed in a deep tank of processing solution wherein the volume of solution is much greater than the volume of the element therein immersed and wherein the volume of solution is much greater than the swollen volume of the light sensitive emulsion layers coated upon the photographic element. The developer typically reduces the exposed silver halide of the element to metallic silver and the resulting oxidized color developer reacts with incorporated dye-forming couplers to yield dye images corresponding to the imagewise exposure. Since silver is generally gray and desaturates the pure colors of the dyes, it is desirable to remove it from the dye images. Silver is conventionally separated from the dye images by a process of bleaching the silver to a silver halide and removing the silver halide by using an aqueous solvent, a fixing bath. This fixing bath also removes the undeveloped silver halide. Commonly, the bleach and fix are combined into one solution, a bleach-fix solution.

Color Diffusion Transfer Systems

Diffusion transfer processes in photography are well known. Cieciuch et al., in U.S. Pat. Nos. 3,719,489 and 4,060,417, describe photographic processes employing certain compounds which are stable in a photographic processing composition but capable of undergoing cleavage in the presence of an imagewise distribution of silver ions created during processing of a silver halide emulsion to liberate a photographically active reagent or a dye in an imagewise distribution corresponding to that of said silver ions. Depending on the photographic process and the result it is desired to achieve, the inert parent compound may be diffusible or substantially nondiffusible in the processing solution and the reagent liberated also may be diffusible or substantially nondiffusible in the processing composition.

Land, in U.S. Pat. No. 3,615,421, Taylor, in U.S. Pat. No. 4,202,694, and Murphy, in U.S. Pat. No. 4,680,247, disclose laminated multilayer diffusion transfer film units that comprise two supports (forming the outer surfaces of the respective units). One of said supports is a transparent support (through which the final color dye image is observed), and the other of said supports is usually an opaque support or a transparent support with an adjacent opaque layer. Processing fluids in such film units are dispersed from rupturable pods between various layers inside said units.

Pfingston, in U.S. Pat. No. 4,401,746, discloses a diffusion transfer element comprising in order a topcoat protective layer, light-sensitive and dye providing layers, a stripping layer, a dyeable stratum, and a support. The processing composition may be applied to the exposed photosensitive element by dipping. The developing agent may be any of those commonly employed. The dyeable stratum together with any other image-receiving components are separable from the photosensitive component using the stripping layer.

Boie and Wingender, in U.S. Pat. No. 4,407,929, disclose a photographic material for dye diffusion transfer, wherein said material comprises a transparent support, a light sensitive element, a light-reflecting opaque layer, and an image receiving layer. Said material provides development control on viewing, wherein the first two minutes of development are conducted in the dark and the remainder of the development is conducted in ambient light. Said light sensitive element comprises silver halide, an electron donor compound, and a non-diffusing reducible color-providing compound which, in reduced form, liberates a diffusible dye under alkaline development conditions. The essential layer elements of said material form a non-disconnectable assembly of layers in the sequence (1) transparent support, (2) light sensitive element, (3) opaque light reflecting layer, and (4) image-receiving layer.

Boie et al., in U.S. Pat. No. 4,429,033, disclose a process for color print production by diffusion transfer, wherein the diffusion transfer element comprises, in order, a transparent layer support, a light-sensitive element comprising silver halide and a non-diffusing color-providing compound, a light-reflecting opaque layer, and a mordant layer. After development, silver and silver halide are removed by bleaching and fixing.

Boie et al., in U.S. Pat. No. 4,508,809, disclose a process and apparatus for exposing and developing photographic images in diffusion transfer elements. Said element comprises a monosheet material containing a layer which is impermeable to light but permeable to moisture. Said layer divides said element into a photosensitive side for image-wise exposure and a non-photosensitive side for observation and supplying of activator or developer solution. The photosensitive side of said element is exposed image-wise in the dark and then sealed in said apparatus in a light-proof manner, whereby the non-photosensitive side of the element lies open and is exposed to an activator to develop the image. Said exposure to activator may be done in daylight, and once the image quality has been achieved, development is stopped by removal of activator, rinsing, and drying the element in the conventional manner.

Finn and DeBoer, in U.S. Pat. No. 4,485,165, disclose diffusion transfer elements for producing monochromatic dye images comprising (1) a support having thereon a layer of nondiffusible dye image-providing material, a stripping layer, an opaque layer, and a silver halide emulsion layer; (2) a transparent cover sheet; and (3) an opaque processing composition for application between the element and cover sheet. A dye mordant layer may also be present on the element or cover sheet. After exposure and processing, the layer of nondiffusible dye image-providing material on a support is stripped away to provide a monochromatic retained dye image without the need for bleaching and fixing.

Kinsman et al., in U.S. Pat. No. 4,519,689, disclose a method and apparatus for processing discrete sheets of rapid access film exemplified by diffusion transfer film. The apparatus comprises opposing transport webs; these webs convey donor and receiver film sheets and means are provided for applying processing fluid between these donor and receiver sheets.

Karino, in U.S. Pat. No. 5,112,720, discloses a color diffusion transfer film unit comprising (1) a support having a light-shielding function in itself and/or having thereon a layer having a light-shielding function; (2) a light sensitive element on the support comprising, in order from the support at least (a) a color image receiving layer, (b) a peeling layer, and (c) at least one silver halide emulsion layer associated with a color image-forming substance; (3) a light-shielding agent containing alkali processing composition; and (4) a cover sheet comprising at least a layer having a neutralizing function on a transparent support, wherein said cover sheet is characterized by having a dye-trapping layer comprising a mordant in a binder adjacent to the alkali processing composition.

Willis and Texter, in U.S. application Ser. No. 7/804,877 filed Dec. 6, 1991, disclose a heat image separation system that uses conventional wet development of silver halide containing elements to create thermal dye diffusion images. Bleaching and fixing components of the wet development process are avoided, and the dye image is separated from the silver image by heat activated thermal transfer of the dye image to a polymeric receiving layer. Said images are subsequently further separated when the donor layers are stripped from the receiver layer.

Diffusible Dye Forming Compounds

The use of diffusible dyes in photographic image transfer systems is well known, as is the formation of diffusible dyes from nondiffusing dye forming compounds. Whitmore and Mader, in British Patent Specification Nos. 840,731 and 904,364 and in U.S. Pat. No. 3,227,550, discuss the use of such compounds in certain image transfer photographic systems. Their inventions utilized preferred diffusible dye forming compounds which may be described as couplers of the general structure R—Cp—R′ where Cp is a coupler residue forming a dye with a p-phenylenediamine or other developing agent, R is a removable substituent in the coupling position such as a ballast group rendering the coupler nondiffusing or a removable preformed dye molecule, and R′ is a ballast group or a solubilizing group in a noncoupling position of the coupler residue. Either R or R′ or both may contain solubilizing groups rendering the dye formed or split off during or after development diffusible in the photographic element wetted with processing solutions such as alkaline development solutions.

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Sakanoue, Hirano, Adachi, Minami, and Kanagawa in German Offen. No. 3,324,533 A1, Booms and Holstead in U.S. Pat. No. 4,420,556, and Arakawa and Watanabe in European Patent Specification 115,303 B1 disclose the use of diffusible dye forming couplers to provide photographic materials with improved graininess.

Figueras and Stern disclose in U.S. Pat. No. 3,734,726 the use of substantially colorless m-sulfonamidoaniline and m-sulfonamidophenol compounds which react with oxidized color development agents to release a coupler moiety which couple with oxidized color developing agent to produce diffusible dye in color diffusion transfer elements and processes. Fleckenstein discloses in U.S. Pat. No. 3,928,312 and Fleckenstein and Figueras disclose in German Offen. No. 2,242,762, in U.S. Pat. No. 4,076,529 the use of p-sulfonamidoaniline, p-sulfonamidophenol, p-sulfonamidonaphthol, and related compounds which react with oxidized color development agents to release diffusible dyes in color diffusion transfer elements and processes.

Bloom and Stephens in U.S. Pat. Nos. 3,443,939 and 3,498,785, Bloom and Rogers in U.S. Pat. No. 3,443,940, and Bloom in U.S. Pat. No. 3,751,406 disclose the use of m-amidophenols, m-amidoanilines, and related compounds that release dyes or dye precursors upon reaction with oxidized color developer in color diffusion transfer units and processes.

Barrier Layers

Becker, in U.S. Pat. Nos. 3,384,483 and 3,477,849, discloses the use of a barrier layer comprising an alkali-permeable, water-insoluble polyvalent metal salt of a film-forming alkali-permeable, water-soluble polymeric carboxylic acid useful in preparing multicolor dye developer diffusion transfer images. The barrier layer functions to reduce color contamination of the transferred images by impeding the diffusion of the dye developer.

Kruck, in U.S. Pat. No. 3,885,969, discloses the use of a lyophobic barrier layer consisting of a salt of an acetate of polyvinylalcohol or of a hydroxyl-containing copolymer and an aldehyde sulfonic acid, between plasticized support layers and an antihalation layer, in dye image providing materials.

Cardone, in U.S. Pat. No. 3,888,669, discloses the use of barrier layers in multilayer and multicolor composite diffusion transfer film units. Said diffusion transfer film units comprise diffusible dye forming layers, a dye fixing layer or a dye mordanting layer, an opaque layer or means for producing an opacifying layer, a barrier layer impermeable to the diffusible dyes produced but permeable to a contacting processing composition, a dimensionally stable transparent layer adjacent to the barrier layer, means for interposing between said barrier layer and said adjacent dimensionally stable transparent layer a processing composition, and means for maintaining the composite film unit intact subsequent to diffusion transfer processing of the unit.

The use of spacer layers or timing layers as barrier layers to delay the function of neutralizing layers in diffusion transfer processes is described in U.S. Pat. Nos. 2,584,030, 3,419,389, 3,421,893, 3,433,633, 3,455,686, 3,592,645, 3,756,815, and 3,765,893, and in *Research Disclosure*, Vol. 123, July 1974, Item No. 12331, entitled *Neutralizing Materials in Photographic*

*Elements.* Specific polymeric materials which have been demonstrated to be effective as barrier layers between dye image forming units have been disclosed in U.S. Pat. Nos. 3,384,483, 3,345,163, and 3,625,685.

The use of barrier layers during development in image diffusion transfer elements, particularly integral elements, to prevent diffusion of materials to the image receiving layer has been described by Buckler et al. in U.S. Pat. No. 3,679,409. Such barrier layers allow diffusion of image forming materials or products of such materials at high pH, such as the pH of the processing composition, prevent diffusion of such materials at low pH, and thereby prevent diffusion of the image forming materials after processing. Other means for forming barrier layers are disclosed in U.S. Pat. Nos. 3,576,626 and 3,597,197.

Hannie, in U.S. Pat. No. 4,056,394, discloses a timing layer which serves as a temporary barrier to penetration of alkaline processing solution. Said timing layer comprises 5 to 35 weight percent of polymerized ethylenically unsaturated monomer, 2 to 10 percent by weight of polymerized ethylenically unsaturated carboxylic acid, and 55 to 85 percent by weight of polymerized vinylidene chloride.

Brust et al., in U.S. Pat. No. 4,088,499, disclose a selectively permeable layer for diffusion transfer film units that is pH selectively permeable and comprises 0 to 100 mole percent of a polymerized monomer containing at least one active methylene group, from 0 to 90 mole percent of at least one additional hydrophilic polymerized ethylenically unsaturated monomer, and 0 to 80 mole percent of at least one additional hydrophobic polymerized ethylenically unsaturated monomer.

Abel, in U.S. Pat. Nos. 4,229,516 and 4,317,892, discloses a temporary barrier layer for use in color image transfer film units comprising a mixture of (1) 5 to 95 percent by weight of a copolymer comprising 55 to 85 percent by weight of vinylidene chloride, 5 to 35 percent by weight of an ethylenically unsaturated monomer, and 0 to 20 percent by weight of an ethylenically unsaturated carboxylic acid, and (2) from 5 to 95 percent by weight of a polymeric carboxy-ester lactone.

Mizukura and Koyama disclose, in U.S. Pat. No. 4,407,938, the use of a lactone polymer and a vinylidene chloride terpolymer in formulating temporary barrier layers.

Helling et al., in European Patent Document No. 48,412, disclose the formulation of temporary barrier layers of reduced permeability for alkali using copolymers of acid containing, acid free, and cross-linking monomers.

Abel and Bowman, in U.S. Pat. No. 4,504,569, disclose a temporary barrier layer comprising N-alkyl substituted acrylamide and a polymerized crosslinking monomer wherein the polymer has a solubility parameter from 13 to 16 at 25° C. The barrier layer is useful as a process timing layer in color image transfer film units.

Hayashi et al., in U.S. Pat. No. 4,614,681, disclose the use of a copolymer, having ethylene and vinyl alcohol repeating units, as a barrier layer to oxygen diffusion.

Bowman and Verhow, in U.S. Pat. No. 4,865,946, disclose a temporary barrier layer comprising polymerizable monomers of certain acrylamides, crosslinking groups, and other ethylenically unsaturated monomers. Said barrier layers are useful in color image transfer units.

Holmes and Campbell, in U.S. Pat. No. 4,055,429, disclose a polymeric barrier layer for scavenging diffusible dyes.

Mordants

Klein et al., in U.S. Pat. No. 4,450,224, disclose polymers comprising repeating units derived from $\alpha,\beta$-ethylenically unsaturated monomers, acrylonitrile or methacrylonitrile repeating units, alkyl substituted imidazole repeating units, and similar imidazolium repeating units. Nakamura et al., in U.S. Pat. No. 4,594,308 and in European Patent Specification 144,059 B1, disclose polymeric mordants comprising a monomer unit having an imidazole ring and comprising a monomer unit having a sulfinic acid group. Said mordants provide improved light and thermal stability for dyes attached thereto. Aono et al., in U.S. Pat. No. 4,619,883, disclose the use of terpolymers as dye fixing materials, wherein said terpolymers comprise imidazole and imidazolium repeating units. Aono et al., in U.S. Pat. No. 4,636,455, disclose a variety of polymeric mordants suitable for use as dye fixing materials in diffusion transfer systems. Such polymers typically contain vinyl monomer units having tertiary amino groups or quaternary amino groups. Nakamura et al., in U.S. Pat. No. 4,766,052, disclose polymeric mordants which comprise imidazole containing repeating units and comprising repeating units from at least one of three types of modified ethylenic groups. Shibata and Hirano, in U.S. Pat. No. 4,774,162, disclose polymeric mordants which comprise imidazole ring containing repeating units and comprising repeating units derived from at least one of three types of alkoxide modified ethylenic groups.

Yamanouchi et al., in U.S. Pat. No. 5,023,162, disclose polymeric mordants that comprise dye stabilizing repeating units in addition to tertiary amino or quaternary ammonium salt repeating units for dye fixing.

PROBLEM TO BE SOLVED BY THE INVENTION

Bleach-fix solution commonly contain iron, ammonium, ethylenediaminetetraacetic acid, thiosulfate and, after use, silver. These components of "wet" silver halide processing are the source of much of the pollution from photofinishing processes.

Photographic elements containing image-transfer diffusible dyes, when processed in developer baths of the type normally encountered in the photofinishing trade, suffer from a high degree of dye washout. This washout represents a major inefficiency in dye utilization, since the dye which washes out into the developer solution or other processing solution is no longer available to provide a dye image in the photographic element. Furthermore, this washout results in severe seasoning of the developer baths and in the unwanted accumulation of precipitates in low pH stop and bleaching baths. Most color diffusion transfer systems require the physical separation of donor and receiver elements during or immediately following development of the color diffusion transfer image. This separation results in the accumulation of solid waste.

Heat image separation systems, comprising wet development and thermal dye diffusion transfer, achieve significant reductions in processing effluent, but require a separate thermal processing step and excessively lengthy thermal activation in order to obtain desired levels of transferred dye density.

These and other problems may be overcome by the practice of our invention.

SUMMARY OF THE INVENTION

It is an object of our invention to reduce the amount of waste processing solution effluents generated by the overall processing system while retaining the benefits of image quality and industry compatibility which are derived from wet development with conventional developing solutions.

An object of the present invention is to provide a color photographic material with a high density and low fog image. A further object of the present invention is to provide improved image dye retention in the photographic element. Yet another object of the present invention is to minimize the seasoning of processing solutions with diffusible dyes. An additional object of the present invention is to minimize the amount of solid waste generated in the photofinishing of color print materials.

These and other objects of the invention are generally accomplished by providing a photographic color diffusion transfer element provided wherein said element comprises a single dimensionally stable transparent support and coated thereon in reactive association and in sequence (1) a mordant layer for binding diffusible dyes, (2) a light reflecting layer, (3) imaging layers comprising a radiation sensitive layer comprising silver halide and a diffusible dye forming layer comprising a diffusible dye forming compound, and (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound. In another preferred embodiment, the sequential arrangement of layers next to the support is in the order: (1) imaging layers comprising a radiation sensitive layer comprising silver halide and a diffusible dye forming layer comprising a diffusible dye forming compound, (2) a light reflecting layer, (3) a mordant layer for binding diffusible dyes, (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound.

ADVANTAGEOUS EFFECT OF THE INVENTION

The present invention reduces the amount of waste processing solution effluent generated by the overall processing system while retaining the benefits of image quality and industry compatibility which are derived from wet development with conventional developing solutions. The invention also provides improved image dye retention in the photographic element and minimizes the seasoning of processing solutions with diffusible dyes. The invention also minimizes the amount of solid waste generated in the photofinishing of color print materials.

DETAILED DESCRIPTION OF THE INVENTION

The term "nondiffusing" used herein as applied to the couplers and diffusible dye forming compounds has the meaning commonly applied to the term in color photography and denotes materials which for all practical purposes do not migrate or wander through organic colloid layers, such as gelatin, comprising the sensitive elements of the invention. The term "diffusible" as applied to dyes formed from these "nondiffusing" couplers and compounds in the processes has the converse meaning and denotes materials having the property of diffusing effectively through the colloid layers of the sensitive elements in the presence of the "nondiffusing" materials from which they are derived.

Key to this invention is the arrangement of various generic layers in the integral diffusion transfer element. The basic layers may be described as (1) a transparent support, (2) a mordanting layer for fixing diffusible dye, (3) a relatively opaque light-reflecting layer, (4) an imaging layer comprising radiation sensitive material and diffusible dye while said element is in contact with an external developing bath. Any of these basic layers may comprise one or more actual layers. In a preferred embodiment, these generic layers are arranged in the above listed sequence, wherein the element is exposed through the barrier layer, developed by contacting the barrier layer to an external developing bath, and the image is viewed through the transparent support. In another preferred embodiment, the above layers are arranged in the sequence: (1) a transparent support; (4) an imaging layer comprising radiation sensitive material and diffusible dye forming compounds; (3) a relatively opaque light-reflecting layer; (2) a mordanting layer for fixing diffusible dye; and (5) a barrier layer for impeding the diffusion of diffusible dye while said element is in contact with an external developing bath, wherein the element is exposed through the transparent support, developed by contacting the barrier layer to an external developing bath, and the image is viewed through the barrier layer. Many embodiments may be constructed, with variations in layer structure and composition, which fall within the spirit and scope of the present invention, so long as said embodiments comprise the above listed basic layers and further do so such that said barrier layer is situated so as to impede the diffusion of diffusible dyes into an external developing bath.

Preferred diffusible dye forming compounds are of various types. Particularly preferred are compounds of the type Dye-Y-Cp-D-B (I)

where D is a photographically inert linkage joining a ballast group B to a coupler residue Cp in a noncoupling position and Y is a splittable linkage, such as an azo group, attaching the diffusible dye moiety (Dye) to the coupler residue in the coupling position. Such compounds are nondiffusing couplers having a removable solubilized preformed azo or other dye-forming moiety in the coupling position through a linkage which is split during development leading to the formation of a dye diffusible in layers wetted with processing solutions, and, when necessary because of the diffusible nature of the molecule, a ballast group in a noncoupling position rendering the compound nondiffusing.

Preferred also are compounds of the type

B-Y-Cp-D-R (II)

where D is a photographically inert linkage joining the solubilizing group R to the coupler moiety Cp in a noncoupling position, and Y is a splittable linkage joining the ballast group B to the coupler residue in the coupling position. These nondiffusing couplers have a removable ballast group that renders the coupler nondiffusing until the ballast is split off during development and a solubilizing group in a noncoupling position that imparts diffusibility to the dye obtained in photographic processing solutions such as alkaline developing solutions.

Preferred photographically inert linkages, D, include —N=N—, —O—, —Hg—, >CH—, =CH—, —S—, —S—S—. Other preferred inert linkages include those disclosed in British Patent Specification No. 904,364 on page 4 in lines 6 through 12, and are incorporated herein by reference.

The acidic solubilizing radicals attached to the diffusible dye forming compounds described above can be solubilizing radicals which when attached to the coupler or developer moieties of the dyes, render the dyes diffusible in alkaline processing solutions. Preferred solubilizing groups which render the dyes diffusible in alkaline processing solutions include $—SO_3H$, $—CH_2OH$, $—C_2H_4OH$, $—CH(OH)CH_2OH$, $—PO_3H_2$, $—AsO_3H_2$, —COOH, and $—SO_2NH_2$.

Preferred dye radical substituents include azo, azomethine, indoaniline, indophenol, anthraquinone, and related dye radicals well known in the art that exhibit selective absorption in the visible spectrum. The dye radicals contain acidic solubilizing moieties.

The nature of the ballast groups in the coupler compounds is not especially critical as long as the groups confer nondiffusibility to the coupler compounds and do not have a character such that the diffusible dyes are prevented from being formed through reaction with the developer. Typical ballast groups exemplified hereinafter in the specific couplers disclosed include long chain alkyl radicals linked directly or indirectly to the coupler molecules by a splittable linkage or by a removable or irremovable but otherwise nonfunctional linkage depending upon the nature of the coupler compound. Preferred ballast groups have eight or more carbon atoms.

Examples of preferred ballast groups B1–B34 are listed in Table 1. In these groups $R_1$ is long or short chain alkyl or aralkyl, $R_2$ and $R_3$ are long or short chain alkyl, $R_4$ is substituted or unsubstituted alkyl or aryl, and $X_1$ represents hydrogen, alkyl, alkoxy, halogen, $—CO_2R_5$, $—NHSO_2R_5$, $—NHCOR_5$, where $R_5$ is long or short chain alkyl.

TABLE 1

Ballast Groups

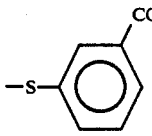

B1

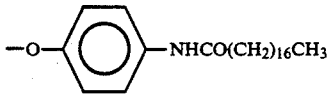

B2

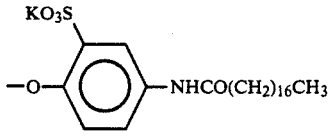

B3

TABLE 1-continued

Ballast Groups

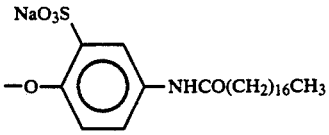

B4

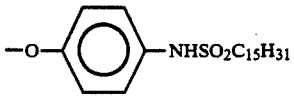

B5

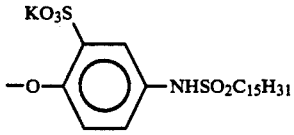

B6

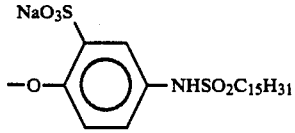

B7

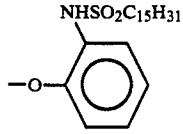

B8

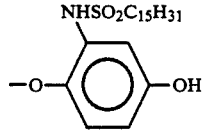

B9

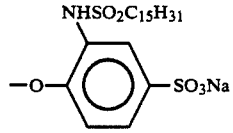

B10

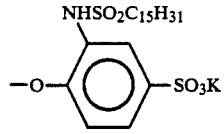

B11

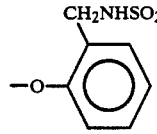

B12

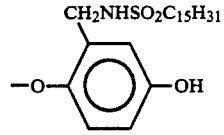

B13

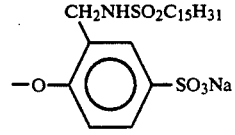

B14

TABLE 1-continued

| Ballast Groups | |
|---|---|
| 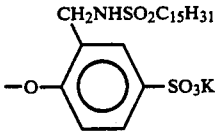 | B15 |
| 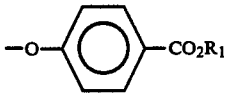 | B16 |
| 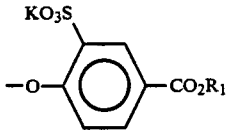 | B17 |
| 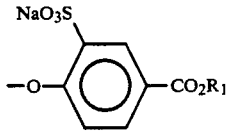 | B18 |
| 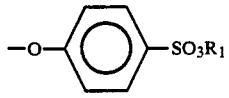 | B19 |
| 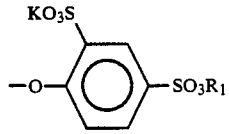 | B20 |
| 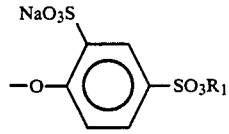 | B21 |
| 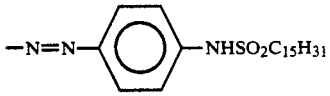 | B22 |
| 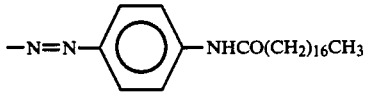 | B23 |
| 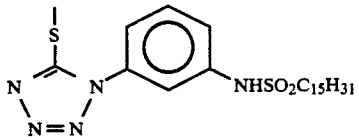 | B24 |
| 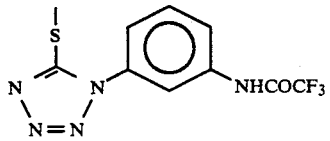 | B25 |

TABLE 1-continued

| Ballast Groups | |
|---|---|
| 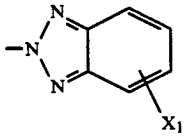 | B26 |
| 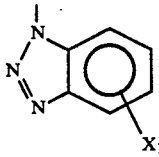 | B27 |
| 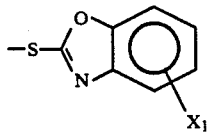 | B28 |
| 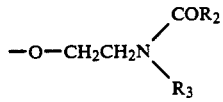 | B29 |
| 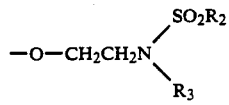 | B30 |
| $-S-(CH_2)_n-CO_2R_2$ | B31 |
| $-NHSO_2R_4$ | B32 |
| 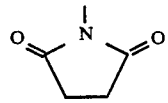 | B33 |
| 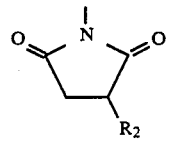 | B34 |

It will be understood by one skilled in the art that these illustrated ballast groups are representative and not exclusive.

The coupler residues in the above structures I and II are well known in the photographic art, as are the corresponding coupling positions. 5-Pyrazolone coupler radicals couple at the carbon atom in the 4-position; phenolic coupler radicals, including α-naphthols, couple at the carbon atom in the 4-position; open chain ketomethylene coupler radicals couple to the carbon atom forming the methylene moiety, for example, the C atom in the —CO—$CH_2$—CO— group. Preferred examples of diffusible dye forming compounds are disclosed in British Patent Specification No. 904,364 on pages 6 through 14 as compound I through XXX and are incorporated herein by reference. Preferred examples of diffusible dye forming compounds are disclosed in U.S. Pat. No. 3,227,550 in columns 4 through 17 as compound I through LV and are incorporated herein by reference. Preferred examples of diffusible dye forming compounds designated as couplers Y-1 through Y-15, M-1 through M-15, and C-1 through C-19 are disclosed in European Patent Specification No. 115,303 B1 of Arakawa and Watanabe on pages 9–23 of the published specification and in German Offen. No. 3,324,533 A1 of Sakanoue et al. on pages 20–41. Preferred examples of diffusible dye releasing couplers are disclosed in U.S. Pat. No. 4,141,730 of Minagawa et al. as Compounds 1–35 in columns 5–20 of the specification and are incorporated herein by reference.

Other preferred diffusible dye forming compounds are of the type

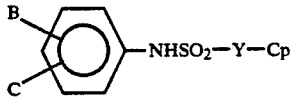

(III)

wherein Cp is a photographic coupler moiety capable of reacting with oxidized aromatic primary amino color developing agent to produce diffusible dye or diffusible dye radical or diffusible dye precursor, B- is a ballast radical as described above, and -G is —OR or —$NR_1R_2$ wherein R is hydrogen or a hydrolyzable moiety and $R_1$ and $R_2$ are each hydrogen or an alkyl group, and -Y- is a divalent linking group. It is particularly preferred in the compounds of structure III that $R_1$ and $R_2$ are alkyl groups having 8 to 22 carbon atoms. Preferred examples of diffusible dye forming compounds according to structure III are disclosed by Figueras and Stern in U.S. Pat. No. 3,734,726 (May 22, 1973) in column 5 and designated as compounds 1 through 6 and are incorporated herein by reference. Other preferred examples of diffusible dye forming compounds according to structure III are disclosed by Fleckenstein and Figueras in German Patent No. 2,242,762 (May 22, 1973) on pages 21–49 and designated as compounds I through XLV.

Further preferred are diffusible dye forming compounds of the type

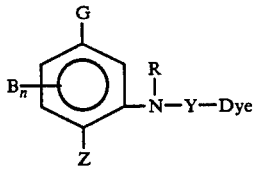

(IV)

wherein $B_n$ is one or more photographically inert organic ballasting radicals of such molecular size and configuration as to render said molecule nondiffusible during development in alkaline color developing solution; G is an —OR′ or —$NR_1R_2$ radical wherein R′ is hydrogen or a hydrolyzable moiety and $R_1$ and $R_2$ are each hydrogen or an alkyl group; Z is hydrogen or is selected from the group consisting of radicals replaceable by oxidized aromatic amino color developer; R is hydrogen, alkyl, or substituted alkyl; Y is a divalent linking radical linking selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula IV have been disclosed in columns 5–7 of U.S. Pat. No. 3,443,939 (May 13, 1969) of Bloom and Stephens and designated as compounds 1–9, and are incorporated herein by reference.

Additionally preferred are diffusible dye forming compounds of the type

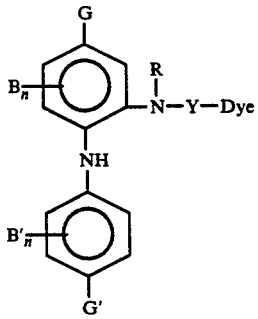

(V)

wherein $B_n$ and $B'_n$ each represent a photographically inert organic ballasting radicals of such molecular size and configuration as to render said molecule nondiffusible during development in alkaline color developing solution; G and G′ each is hydrogen, hydroxy, —OR′, or —$NR_1R_2$ radical wherein R′ is a hydrolyzable moiety and $R_1$ and $R_2$ are each hydrogen or an alkyl group provided at least one of G and G′ is hydroxy or amino; R is hydrogen, alkyl, or substituted alkyl; Y is a divalent linking radical linking selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula V have been disclosed in columns 7–13 of U.S. Pat. Nos. 3,443,939 (May 13, 1969) and 3,498,785 (Mar. 3, 1970) of Bloom and Stephens and designated as compounds 1–23, and in columns 9–13 of U.S. Pat. No. 3,751,406 (Aug. 7, 1973) of Bloom as compounds designated 9–31, and are incorporated herein by reference.

Couplers according to formulae I, II, and III may be synthesized by methods well known in the art. In particular, diffusible dye-forming compounds according to structures I and II may be synthesized according to methods detailed in British Patent Specifications 840,731 (Jul. 6, 1960) and 904,364 (Aug. 29, 1962) of Whitmore and Mader, in U.S. Pat. No. 3,227,550 (Jan. 4, 1966) of Whitmore and Mader, in U.S. Pat. No. 4,141,730 (Feb. 27, 1979) of Minagawa et al., in U.S. Pat. No. 4,420,556 (Dec. 13, 1983) of Booms and Holstead, in German Offen. No. 3,324,533 A1 (Jan. 12, 1984) of Sakanoue et al., and in European Patent Specification No. 115,303 B1 (Oct. 4, 1989) of Arakawa and Watanabe. The disclosures of U.S. Pat. Nos. 3,227,550, 4,141,730, and 4,420,556 are incorporated herein by reference. Compounds of formulae I and II may be synthesized, for example, by using methods described in U.S. Pat. Nos. 3,227,554, 4,264,723, 4,301,235, and 4,310,619 and in Japanese Patent Applications (OPI) 1938/81, 3934/82, 4044/82, 105226/78, 122935/75, and 126833/81. Compounds according to formula III may be synthesized by methods described in U.S. Pat. Nos. 3,734,726 (May 22, 1973) of Figueras and Stern, 3,928,312 (Dec. 23, 1975) of Fleckenstein, and 4,076,529 (Feb. 28, 1978) of Fleckenstein and Figueras, and in German Patent No. 2,242,762 (Mar. 8, 1973) of Fleckenstein and Figueras. Compounds according to formulae IV and V may be synthesized by methods described or referenced in U.S. Pat. Nos. 3,443,939 (May 13, 1969)

and 3,498,785 (Mar. 3, 1970) of Bloom and Stephens and 3,751,406 (Aug. 7, 1973) of Bloom.

Color developing agents which are useful with the nondiffusing couplers and compounds of this invention include the following:

4-amino-N-ethyl-3-methyl-N-β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4-amino-N-methyl-N-(β-carboxyethyl)aniline
4-amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline Certain polymers of this invention can be used as barrier layers to diffusible dyes and their precursors. The barrier polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the barrier polymers of this invention do not contain groups which significantly absorb, scavenge, or mordant diffusible dyes, for example, secondary, tertiary, or quaternary ammonium groups. The polymer should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The preferred polymers are cationic. The molecular weight of the polymers must be such that they are practical to coat, and is preferably 50,000 to 1,000,000.

The polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers, particularly acrylate, methacrylate, acrylamide and methacrylamide monomers which includes analogs of said monomers.

The more preferred polymers contain repeating units of the formula -(A)-(B)-wherein A is a hydrophobic ethylenically unsaturated monomer and B is an ionic hydrophilic ethylenically unsaturated monomer. A may be selected from, for example, vinyl ketones, alkylvinyl esters and ethers, styrene, alkylstyrenes, halostyrenes, acrylonitrile, butadiene, isoprene, chloroprene, ethylene and alkyl substituted ethylenes, alkyl substituted acrylamides, alkyl substituted methacrylamides, haloethylenes, and vinylidene halides. Examples of hydrophobic monomers are listed in *Research Disclosure* No. 19551, p. 301, July, 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anhydride, maleimides, vinylimides, vinylhalides, vinyl aldehydes, substituted styrenes, and vinyl heterocycles. Other examples of ionic monomers are listed in *Research Disclosure* No. 19551, p. 303, July 1980 hereby incorporated by reference. The more preferred monomers of group A and B are acrylamides, methacrylamides, acrylates, and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly useful are polymers containing repeating units derived from ethylenically unsaturated monomers of the formula $-(A)_m-(B)_n-$.

A is a hydrophobic monomer yielding the repeating unit

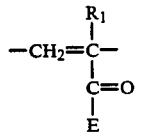

where $R_1$ is hydrogen or methyl; E is $-OR_2$ or $-NR_3R_4$; $R_2$ is a substituted or unsubstituted straight, branched, or cyclic alkyl or aryl group of about 1 to 10 carbon atoms; $R_3$ and $R_4$ are independently selected from hydrogen or any $R_2$ group and $R_3$ and $R_4$ together contain at least 3 carbon atoms; and m is 0 to 99.5 mole percent. B is an ionic hydrophilic monomer yielding the repeating unit

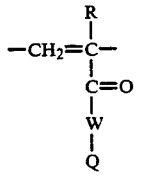

wherein R is hydrogen or methyl; W is $-OR_5$ or $-NR_6R_7$; $R_5$ is a straight, branched, or cyclic alkylene or arylene group of 1 to about 10 carbon atoms; $R_6$ is hydrogen or a straight, branched, or cyclic alkyl or aryl group from 1 to about 6 carbon atoms; $R_7$ is a straight, branched or cyclic alkylene or arylene group of 1 to about 10 carbon atoms, n is 0.5 to 100 mole percent; and Q is an ionic functional group independently selected from:

(a) $-NH_2$ or the acid addition salt $-NH_2$:HX, where X is an appropriate acid anion or
(b) $-CO_2M$, $-SO_3M$, $-OSO_3M$, $-OPO_3M$, and $-OM$ where M is an appropriate cation.

When the polymers of this invention are derived from monomers A and B of the above formula and both A and B are acrylamide or methacrylamide monomers monosubstituted on the amide nitrogen the polymers fall within a class of polymers known as Thermo Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein.

$R_2$, $R_3$, and $R_4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitrile groups. The monomers of group A may also contain reactive functional groups so that the polymers may perform other photographically useful functions common to interlayers between imaging layers and protective layers over imaging layers. $R_2$, $R_3$, $R_4$, $R_5$, $R_6$ and $R_7$ may be substituted with groups that can form heterocyclic rings. The straight, branched or cyclic alkyl groups of A and B include all isomeric forms and may contain one or more sites of unsaturation. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole percent and n is about 0.5 to 100 mole percent. When the polymer is a TRG polymer m is preferably about 40 to 99 mole percent and n is preferably about 1 to about 60 mole percent.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^{2-}$, $HCO_3^-$, and $CO_3^{2-}$ with $Cl^-$ being most preferred. Appropriate cations include, but are not limited to, $H^+$, alkali metal, and ammonium, with $Na^+$ and $H^+$ being most preferred.

Examples of preferred monomers from group A are N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate, and benzylmethacrylate. Examples of preferred monomers from group B are N-(3-aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

The barrier polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary, or quaternary ammonium groups. Preferred monomers are ethylenically unsaturated monomers, for example, N-vinyl pyrrolidone, N-vinyl-e-caprolactam, vinyloxazolidone, vinyl menthyloxazolidone, maleimide, N-methylol-maleimide, maleic anhydride, N-vinylsuccinamide, acryloylurea, cyanomethylacrylate, 2-cyanoethyl acrylate, glycerylacrylate, acryloyloxpolyglycerol, allyl alcohol, vinyl benzyl alcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl-2-acrylamide-2-methoxy acetate, N-hydroxypropylacrylamide, ethylacrylamidoacetate, N-acetamidoacrylamide, N-(m-hydroxyphenyl)-acrylamide, 2-acrylamide-2-hydroxymethyl-1,3-propane diol, and N-(3- or 5-hydroxymethyl-2-methyl-4-oxo-2-pentyl)acrylamide. Other suitable hydrophilic monomers are listed in *Research Disclosure* No. 19551, p. 305, July 1980 hereby incorporated by reference. Examples of preferred hydrophilic nonionic monomers are acrylamide, methacrylamide, N,N-dimethylacrylamide, hydroxyethylacrylamide, hydroxyethyl acrylate, hydroxyethylmethacrylate, hydroxypropyl acrylate, hydroxypropylmethacrylate, and methylene-bis-acrylamide. The hydrophilic nonionic monomer may be 0 to about 70 mole percent and preferably about 10 to 65 mole percent.

The barrier polymer layers must also have enough physical integrity to survive processing intact. Those skilled in the art will recognize that many of the monomers discussed above contain structural elements that will meet this parameter. For example polymers containing the cationic hydrophilic monomer N-(3-aminopropyl)methacrylamide hydrochloride also crosslink in the presence of many gelatin hardeners. Barrier polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates, and carbodimides. Preferred are monomers containing active methylene groups such as 2-acetoacetoxyethylmethacrylate, ethylmethacryloylacetoacetate, and N-2-acetoacetoxyethyl)acrylamide. Alternatively, di- or multi-functional monomers such as methylene-bis-acrylamide or ethylene glycol-dimethacrylate may be used, whereby polymers are prepared as crosslinked colloidal particles that are swellable and dispersible in water. Barrier polymer examples of this invention are comprised of monomers whose structures are shown below in Table 2, and are listed in Table 3 which provides the monomer feed ratios used, charge type, and also indicates which of the polymers are of the preferred TRG class.

TABLE 2

Monomers for Barrier Layer Polymers
$CH_2 = C(XX)(YY)$

Hydrophobic Monomers

IPA (N-isopropylacrylamide)
XX = —H
YY = —(CO)—(NH)—$CH(CH_3)_2$
TBA (N-t-butylacrylamide)
XX = —H
YY = —(CO)—(NH)—$C(CH_3)_3$
NBA (N-butylacrylamide)
XX = —H
YY = —(CO)—(NH)—$C_4H_9$
TBMA (N-t-butylmethacrylamide)
XX = —$CH_3$
YY = —(CO)—(NH)—$C(CH_3)_3$
DOA (N-(1,1-dimethyl-3-oxobutyl)-acrylamide)
XX = —H
YY = —(CO)—(NH)—$C(CH_3)_2$—$CH_2$—(CO)—$CH_3$
NBM (N-butylmethacrylate)
XX = —$CH_3$ TABLE 2-continued

| Monomers for Barrier Layer Polymers $CH_2 = C(XX)(YY)$ |
|---|
| YY = —(CO)—O—$C_4H_9$ |
| 2EHM (2-ethyl-hexylmethacrylate) |
| XX = —$CH_3$ |
| YY = —(CO)—O—$CH_2CH(C_2H_5)CH_2CH_2CH_2CH_3$ |
| BZM (benzylmethacrylate) |
| XX = —$CH_3$ |
| YY = —(CO)—O—$CH_2$-phenyl |
| AAM (2-acetoacetoxyethylmethacrylate; a crosslinker) |
| XX = —$CH_3$ |
| YY = —(CO)—O—$CH_2CH_2$—O—(CO)—$CH_2$—(CO)—$C_4H_{9-n}$ |
| Neutral Hydrophilic Monomers |
| A (acrylamide) |
| XX = —H |
| YY = —(CO)—$NH_2$ |
| HEM (hydroxyethylmethacrylate) |
| XX = —$CH_3$ |
| YY = —(CO)—O—$CH_2CH_2OH$ |
| MBA (methylene-bis-acrylamide; difunctional) |
| $CH_2$=CH—(CO)—(NH)—$CH_2$—(NH)—(CO)—CH=$CH_2$ |
| Cationic Hydrophilic Monomers |
| APM (N-(3-aminopropyl)methacrylamide hydrochloride) |
| XX = —$CH_3$ |
| YY = —(CO)—(NH)—$CH_2CH_2CH_2NH_3^+Cl^-$ |
| AEM (aminoethylmethacrylate hydrochloride) |
| XX = —$CH_3$ |
| YY = —(CO)—O—$CH_2CH_2NH_3^+Cl^-$ |
| Anionic Hydrophilic Monomers |
| SEM (sulfoethylmethacrylate sodium salt) |
| XX = —$CH_3$ |
| YY = —(CO)—O—$CH_2CH_2SO_3^-Na^+$ |
| SSA (N-(2-sulfo-1,1-dimethylethyl)acrylamide sodium salt) |
| XX = —$CH_3$ |
| YY = —(CO)—(NH)—$C(CH_3)_2CH_2SO_3^-Na^+$ |
| CEA (N-2-carboxyethylacrylamide) |
| XX = —H |
| YY = —(CO)—(NH)—$CH_2CH_2CO_2H$ |

TABLE 3

Monomer Composition of Barrier Layer Polymers

| Label | Type | Monomers | Monomer Ratio | TRG? | Ratio % |
|---|---|---|---|---|---|
| D | + | (IPA)(APM) | 90:10 | Yes | Mole |
| E | + | (IPA)(APM) | 92:8 | Yes | Mole |
| F | + | (IPA)(A)(APM) | 85:10:5 | Yes | Mole |
| G | + | (TBA)(APM) | 75:25 | Yes | Mole |
| H | + | (TBA)(APM) | 80:20 | Yes | Mole |
| I | + | (TBA)(APM) | 83:17 | Yes | Mole |
| J | + | (TBA)(APM) | 84:16 | Yes | Mole |
| K | + | (NBA)(APM) | 80:20 | Yes | Mole |
| L | + | (TBMA)(APM) | 80:20 | Yes | Mole |
| M | + | (TBA)(IPA)(APM) | 65:20:15 | Yes | Mole |
| N | + | (DOA)(APM) | 80:20 | Yes | Mole |
| O | + | (TBA)(DOA)(APM) | 60:20:20 | Yes | Mole |
| P | + | (IPA)(MBA)(APM) | 80:10:10 | Yes | Weight |
| Q | + | (NBM)(AEM)(HEM) | 50:15:35 | No | Weight |
| Qa | + | (NBM)(AEM)(HEM) | 50:30:20 | No | Weight |
| R | + | (NBM)(AEM)(HEM) | 40:25:35 | No | Weight |
| S | + | (NBM)(AEM)(HEM) | 26:22:52 | No | Weight |
| T | + | (NBM)(AEM)(HEM) | 20:15:65 | No | Weight |
| U | − | (TBA)(A)(SSA) | 75:20:5 | Yes | Mole |
| V | − | (NBM)(SEM)(AAM)(HEM) | 60:5:10:25 | No | Weight |
| Va | − | (NBM)(SEM)(AAM)(HEM) | 70:2.5:10:17.5 | No | Weight |
| Vb | − | (BZM)(SEM)(AAM)(HEM) | 50:2.5:10:37.5 | No | Weight |
| Vc | − | (2EHM)(SEM)(AAM)(HEM) | 50:5:10:35 | No | Weight |
| Vd | − | (NEM)(SEM)(AAM)(HEM) | 50:5:10:35 | No | Weight |
| Ve | − | (BZM)(SEM)(AAM)(HEM) | 60:2.5:10:27.5 | No | Weight |
| W | ± | (TBA)(CEA)(APM) | 76:8:16 | Yes | Mole |
| X | ± | (TBA)(A)(IPA)(APM) | 76:8:16 | Yes | Mole |
| Y | ± | (TBA)(A)(SSA)(APM) | 65:20:5:10 | Yes | Mole |

The barrier polymers can be prepared by synthetic procedures well known in the art. The polymers of this invention may be coated in the conventional manner. The amount of permeability of the barrier layer may be adjusted by adding gelatin or other water soluble polymers to the layer. Such water soluble polymers may comprise up to 50 percent of the barrier layer, but preferably no more than 25 percent. This method of adjusting permeability is particularly useful with polymers containing a high proportion of hydrophobic monomers and can alleviate the need to prepare different polymers of varying desired levels of permeability. The permeability of the layer may also be adjusted by varying the thickness of the polymer or polymer/gelatin layer. It has also been noted that surfactants or surfactant-like compounds, used with the polymer may affect the permeability. The surfactants or surfactant-like compounds, for example 2,5-dihydroxy-4-(1-methylheptadecyl) benzenesulfonic acid-monopotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability. The TRG polymers described above are a particularly preferred class of polymers of this invention. Solutions of such polymers are advantageous for coating because they can either be heat thickened or chill thickened upon application to a film to form layers with sharp and distinct interfaces. The preparation of TRG polymers is more fully described in U.S. application Ser. No. 7/502,726, which is incorporated herein by reference.

Mordant layers are formulated as combinations of hydrophilic colloidal binder and mordant polymer. The hydrophilic colloidal binder is preferably gelatin. Other preferred binders include gelatin derivatives, polyvinyl alcohol, cellulose derivatives, polysaccharides such as starches and gum arabic, synthetic substances such as water soluble polyvinyl compounds, synthetic substances such as dextrin, pullulan, polyvinyl pyrrolidone and acrylamides. It is known to incorporate UV stabilizers in such dye fixing layers. Such incorporation of UV stabilizers in dye fixing layers has the advantage of achieving UV stabilization without the added cost of coating a separate UV filter layer. It is also known to separate such layers into two sublayers, where one of said sublayers comprises mordant polymer and the other of said sublayers comprises a UV stabilizer. This approach, while suffering the added cost of coating an extra layer, has the advantage of providing superior UV protection and stabilization to the dye image.

Mordant polymers that contain a vinyl monomer unit having a tertiary amino group or a quaternary ammonium group are preferred. Such preferred mordant polymers have been described by Aono et al. in U.S. Pat. No. 4,636,455 and are incorporated herein by reference. Said mordant polymers comprise vinyl monomer unit selected from the group consisting of:

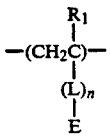

mo-i wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; and n is 0 or 1;

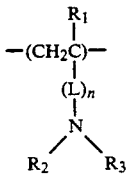

mo-ii wherein $R_1$, L, and n have the same meaning as in formula mo-i; $R_2$ and $R_3$ are the same or different and each represents an alkyl group having 1 to 12 carbon atoms or an aralkyl group having 7 to 20 carbon atoms, and $R_2$ and $R_3$ may form, together with the adjacent nitrogen atom, a cyclic structure;

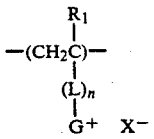

mo-iii wherein $R_1$, L, and n have the same meaning as in formula mo-i; $G^+$ represents a hetero ring which is quaternized and contains a carbon-nitrogen double bond; and $X^-$ represents a monovalent anion; and

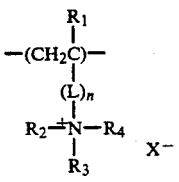

mo-iv wherein $R_1$, L, and n have the same meaning as in formula mo-i; $R_2$ and $R_3$ have the same meaning as in formula mo-ii; $R_4$ has the same definition as $R_2$ and $R_3$; $X^-$ has the same meaning as in formula mo-iii, and $R_2$ and $R_3$, $R_3$ and $R_4$, or $R_2$ and $R_4$ may form, together with the adjacent nitrogen atom, a cyclic structure.

Mordant polymers as described by Klein et al., in U.S. Pat. No. 4,450,224, incorporated herein in its entirety by reference, and comprising vinyl imidazolium, vinyl imidazole, acrylonitrile, methacrylonitrile, and $\alpha,\beta$-ethylenically unsaturated monomers are preferred.

Copolymers of imidazole containing monomers and sulfinic acid containing monomers are preferred mordant polymers. Such mordant polymers have been described by Nakamura et al. in U.S. Pat. No. 4,594,308, the disclosure of which is incorporated herein by reference. Other preferred mordant polymers comprising imidazole containing repeat units have been disclosed by Shibata and Hirano in U.S. Pat. No. 4,774,162, the disclosure of which is incorporated herein in its entirety. Preferred mordant polymers are depicted in Table 6, wherein the repeating-unit subscripts indicate weight percents of the repective repeating units and wherein the chloride anion may be replaced with any monovalent anion.

TABLE 6

| Mordant Polymers | |
|---|---|
| 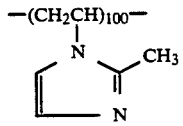 | MO1 |
| 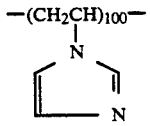 | MO2 |
| 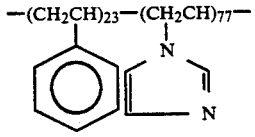 | MO3 |
| 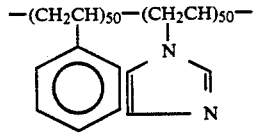 | MO4 |
| 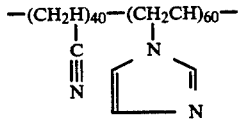 | MO5 |
| 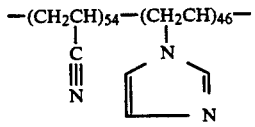 | MO6 |
| 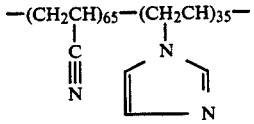 | MO7 |

TABLE 6-continued
Mordant Polymers
MO8
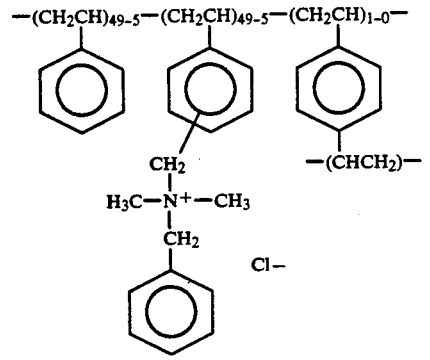
MO9
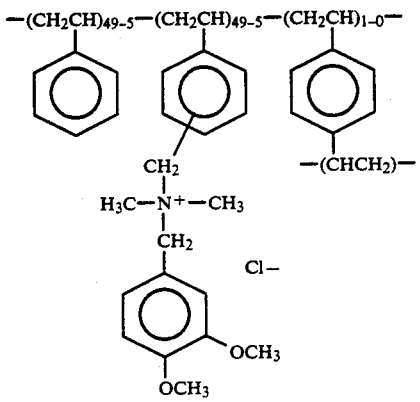
MO10
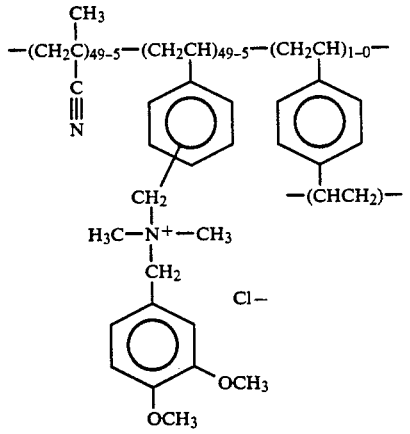
MO11
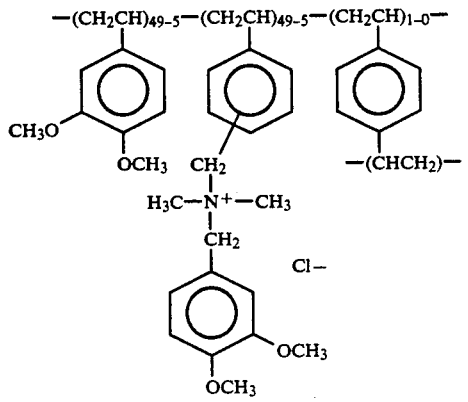
TABLE 6-continued
Mordant Polymers
MO12
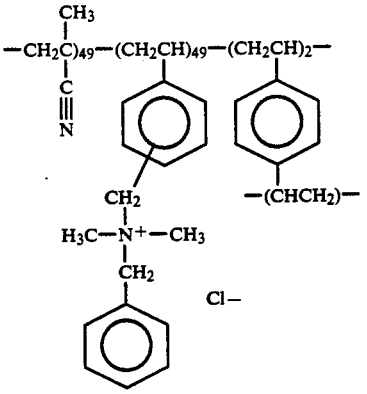
MO13
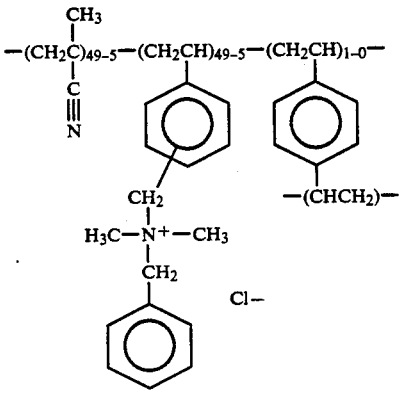
MO14
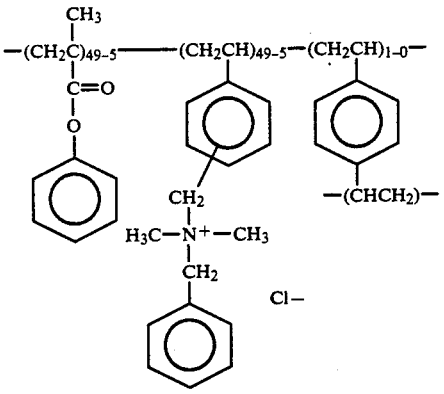
MO15
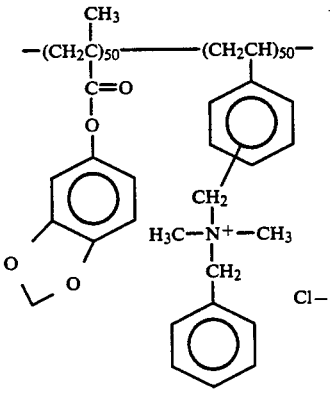

TABLE 6-continued

Mordant Polymers

MO16

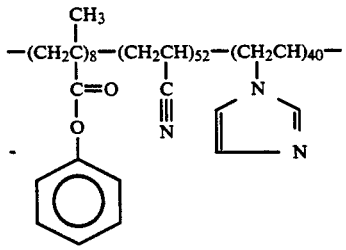

MO17

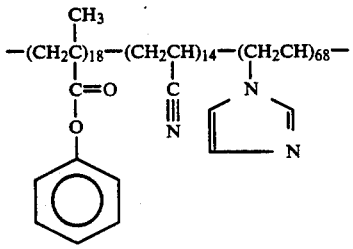

MO18

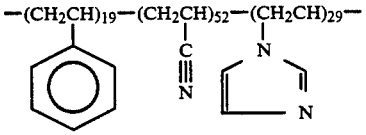

MO19

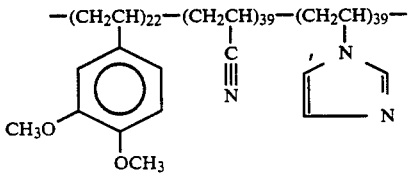

MO20

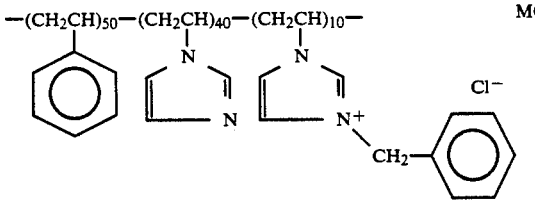

MO21

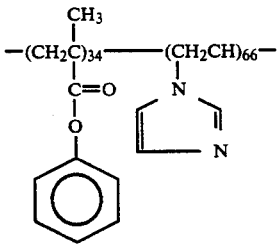

MO22

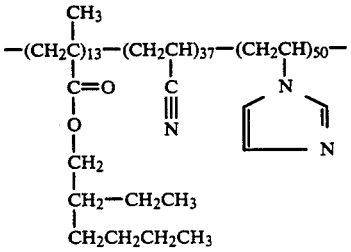

TABLE 6-continued

Mordant Polymers

MO23

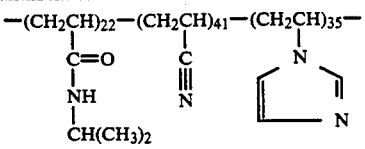

MO24

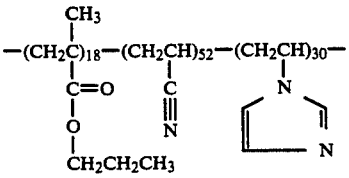

MO25

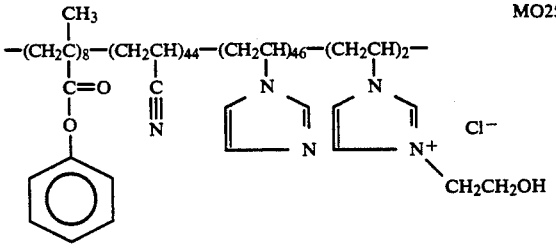

MO26

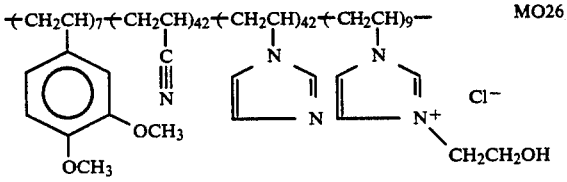

MO27

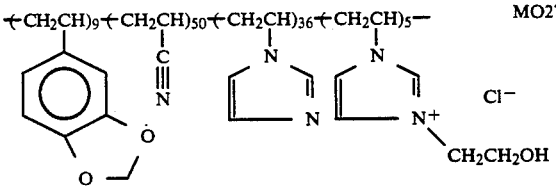

MO28

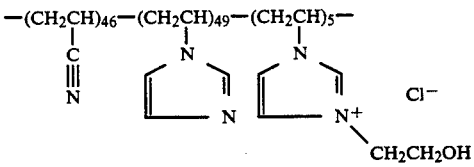

MO29

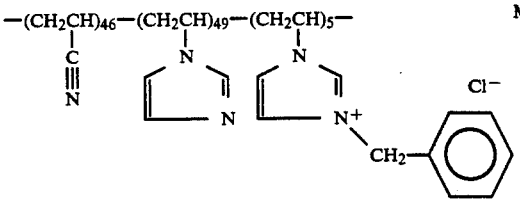

The mixture of colloidal binder (preferably gelatin) and mordant polymer and the amount coated in the formulation of the mordant layer may easily be determined by those skilled in the art and will vary according to the particulars of the element and use, such as the particular polymeric mordant used and the particular development process used. The ratio of mordant polymer to binder is preferably in the range of 1:5 to 5:1 (weight ratio), and the amount of mordant polymer coated is preferably in the range of 0.2–15 g/m$^2$, more preferably in the range of 0.5–8 g/m$^2$. The molecular weight of the polymer mordant used is preferably in the range of 1,000–1,000,000, and more preferably in the range of about 10,000–200,000.

In the following discussion of suitable materials for use in the emulsions, elements, and methods according to the invention, reference will be made to *Research Disclosure*, December 1989, Item 308119, published by Kenneth Mason Publications, Ltd., Emsworth, Hampshire PO10 7DQ, U.K. This publication will be identified hereafter as "*Research Disclosure*". The silver halide emulsion employed in the elements of this invention can be wither negative working or positive working. Examples of suitable emulsions and their preparation are described in *Research Disclosure*, Sections I and II and the publication cited therein. Examples of suitable vehicles for the emulsion layers and other layers of elements of this invention are described in *Research Disclosure*, Section IX and the publications cited therein.

The photographic elements of this invention or individual layers thereof can contain, for example, brighteners (see *Research Disclosure*, Section V), antifoggants and stabilizers (see *Research Disclosure*, Section VI), antistain agents and image dye stabilizers (see *Research Disclosure*, Section VII, paragraphs I and J), light absorbing and scattering materials (see *Research Disclosure*, Section VIII), hardeners (see *Research Disclosure*, Section IX), plasticizers and lubricants (see *Research Disclosure*, Section XII) antistatic agents (see *Research Disclosure*, Section XIII), matting agents (see *Research Disclosure*, Section XVI), and development modifiers (see *Research Disclosure*, Section XXI).

The photographic elements can be coated on a variety of supports such as described in *Research Disclosure*, Section XVII and the references described therein.

Photographic elements can be exposed to actinic radiation, typically in the visible region of the spectrum, to form a latent image as described in *Research Disclosure*, Section XVIII and then processed to form a visible dye described in *Research Disclosure*, Section XIX. Processing to form a visible dye image includes the step of contacting the element with a color developing agent to reduce developable silver halide and oxidizing the color developing. Oxidized color developing agent in turn reacts with the coupler to yield a diffusible dye.

Said contacting of the element with a color developing agent comprises wetting at least the emulsion side of said element with a volume of processing solution that exceeds the swelling volume of the element. The requisite processing solution volume to element area ratio will preferably exceed 20 mL/m$^2$. This ratio will more preferably exceed 200 mL/m$^2$.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image. After image formation the element is subjected to a stop and wash bath that may be the same or different. Thereafter, the element is dried.

The advantages of the present invention will become more apparent by reading the following examples. The scope of the present invention is by no means limited by these examples, however.

EXAMPLES 1–11

Preparation of Barrier Polymer

VMX

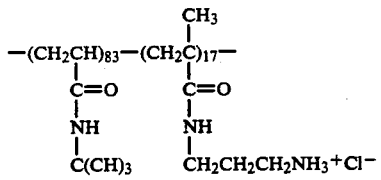

To a three-liter 3-necked flask, fitted with a stirrer and condenser, was added about 450 g of methanol and about 350 g of distilled water. The solution was degassed for about 30 minutes with nitrogen. About 105.4 g of *t*-butyl acrylamide (TBA), about 30.3 g of N-(3-aminopropyl) methacrylamide hydrochloride (APM), and about 0.35 g of AIBN (2,2'-azobisisobutylnitrile) were then added and the solution was stirred at about 60° C. under nitrogen for about 16 hours. A clear, viscous solution was obtained. The condenser was removed and about 1 kg of distilled water was added. The solution was stirred at 80° C. with a strong nitrogen sweep for 16 hours to remove the methanol. The solution was cooled to give a gel containing about 9.7% solids with an IV of 0.86 in 0.1M LiCl. This copolymer polymer of TBA and APM at mole ratio 83:17 (polymer I in Table 3) is designated "VMX" for reference purposes in the following.

Preparation of Mordant Polymer MO8

To a 190 L glass lined reactor equipped with variable speed agitator (reactor 1), automatic temperature control, vacuum, and nitrogen service was added about 104 kg of water with agitation. About 19.6 kg of water was added to a similarly equipped reactor (reactor 2). The space above the water, in each reactor, was evacuated and returned to atmospheric pressure under nitrogen three times. Thereafter nitrogen flow through the reactors was maintained. About 1.1 kg of aqueous Triton® 770 (a 30% by weight aqueous solution) was added to reactor 1, and the temperature control for reactor 1 was set to 64° C. To the other reactor (2) was added about 1.1 kg of Triton 770 (30% by weight) and about 304.6 g (1.30 mol) of 55% (w/w) 1,4-divinylbenzene. About 8.4 kg of styrene and about 12.2 kg of vinylbenzyl chloride were added to reactor 2 under vacuum, and pressure was returned to atmospheric with nitrogen. The temperature of reactor 2 was then set at 64° C. and the emulsion was maintained with agitation. About 19.7 g of sodium metabisulfite and about 162.8 g of potassium persulfate were then added to reactor 1. Within about two minutes, transfer of the emulsion in reactor 2 into reactor 1 was commenced at a rate of 330 mL/min. This transfer was continued for about 120 min.

About 9.9 g of sodium metabisulfite was dissolved in about 900 g of water. Another solution comprising about 16.4 g of potassium persulfate and about 900 g water was prepared. Fifteen minutes after completion of the emulsion charge addition to reactor 1, these two solutions were added to reactor 1. The reaction in reactor 1 was continued with stirring at 64° C. for an additional 3 hours, and then the temperature control was decreased to 20° C. When the reaction mixture temperature dropped to less than 30° C., the latex was filtered through a 50 μm bag filter into a clean 208 L drum. About 147 kg of aquous latex at about 14.75% (w/w) solids was obtained. Reactor 1 was then flushed with water, and the latex suspension was reintroduced into the reactor. Temperature control was set to 25° C. About 11.29 kg of N,N-dimethyl benzylamine was preweighed for subsequent addition. When the temperature of the reaction mixture reached 25° C., intoduction of the N,N-dimethyl benzylamine into reactor 1 was started at a rate of 50 mL/min. When this addition, lasting about an hour, was complete, the temperature controller for reactor 1 was set to 60° C. Agitation was adjusted throughout to maintain stirring while minimizing foaming. When the reaction mixture reached 60° C., the nitrogen feed was stopped, the reactor vent was closed, and stirring was maintained for about 18 hours. After this time the temperature was lowered to 20° C. and the nitrogen flow was resumed. After cooling the product was filtered through a 30 μm filter bag and about 183 kg of the desired latex suspenson of MO8 was obtained.

Preparation of Coupler Dispersions

Dispersions of couplers M (241CG), C (114AHZ), and Y (381HEI), see Table 7, were prepared by milling methods well known in the art. A dispersion of coupler M for Coating 1 was prepared by dissolving about 2.7 g of coupler M in about 8.1 g of cyclohexanone with warming. About 3.6 g of a 10% (w/w) Alkanol-XC (Du Pont) aqueous solution, about 28.8 g of 12.5% (w.w) aqeuous gelatin, and about 46.8 g of water were combined at 50° C. These aqueous and cyclohexanone solutions were then combined and briefly mechanically stirred. The resulting mixture was then passed through a Gaulin colloid mill five times, and the resulting dispersion was noodled and washed to remove the cyclohexanone. After washing, this dispersion was remelted and chill set, and stored in the cold until used for coating. After washing, these dispersions were remelted and chill set, and stored in the cold until used for coating. A dispersion of coupler C for Coating 2 was prepared by roller milling methods. About 3 g of coupler C, about 6 g of 10% aqueous Alkanol XC, about 41 g water, and about 100 mL of 1.8 mm diameter zirconia beads were combined and placed in a 225 mL glass jar. The jar and contents were placed on a roller mill for about 7 days. About 42.2 g of the resulting aqueous slurry of coupler C, about 27.2 g of 12.5% aqueous gelatin, and about 15.2 g of water were combined with stirring to yield a dispersion about 3% by weight in coupler C and about 4% by weight in gelatin. This dispersion was chill set and stored in the cold until used for coating. A dispersion of coupler Y for Coating 3 was prepared by dissolving about 2.7 g of coupler Y in about 8.1 g of cyclohexanone with warming. About 3.6 g of a 10% (w/w) Alkanol-XC (Du Pont) aqueous solution, about 28.8 g of 12.5% (w.w) aqeuous gelatin, and about 46.8 g of water were combined at 50° C. These aqueous and cyclohexanone solutions were then combined and briefly mechanically stirred. The resulting mixture was then passed through a Gaulin colloid mill five times, and the resulting dispersion was noodled and washed to remove the cyclohexanone. After washing to remove cyclohexanone, this dispersion was remelted, chill set, and stored in the cold until used for coating. Dispersions of coupler M for Coatings 4–7 were formulated with a high boiling coupler solvent, N,N-diethyl dodecanamide, at a weight ratio of 1:½ (coupler to coupler solvent). These dispersions were prepared by combining about 5.25 g of coupler M, about 2.63 g of N,N-diethyl dodecanamide, about 15.75 g of cyclohexanone, and heating this mixture with stirring to dissolve the coupler. About 7.0 g of a 10% (w/w) Alkanol-XC (Du Pont) aqueous solution, about 56 g of 12.5% (w.w) aqeuous gelatin, and about 88.4 g of water were combined at 50° C. These aqeuous and cyclohexanone solutions were then combined and briefly mechanically stirred. The resulting mixture was then passed through a Gaulin colloid mill five times, and the resulting dispersion was chill-set, noodled, and washed to remove the cyclohexanone.

TABLE 7.

Coupler Structures

M

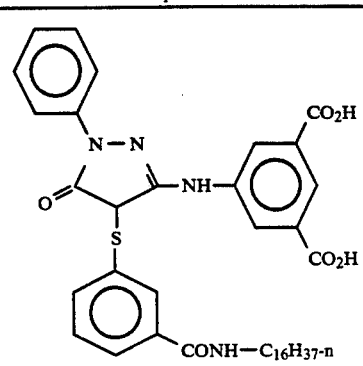

Y

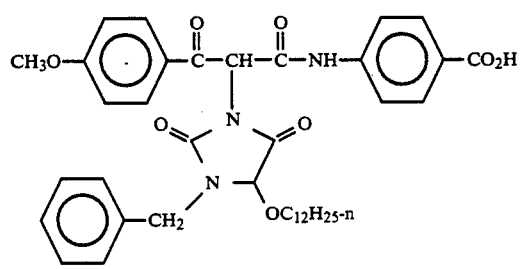

C

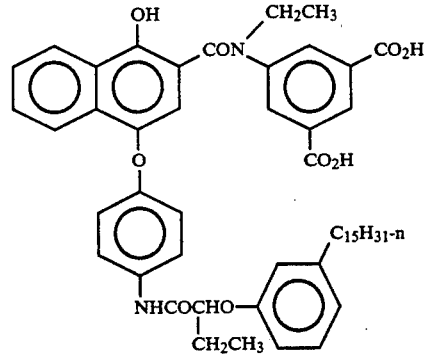

Preparation of Coating Base

A titania-pigmented reflection base was overcoated with a gelatin-mordant polymer mixture. A slurry comprising about 259.5 g of a 17% by weight aqueous suspension of the mordant polymer MO8, about 46.4 g of 95% by weight type V, Class HX/001 doubly deionized gelatin (Rouseleau), and about 931.5 g distilled water was prepared at 50° C. and chill set. This chill set slurry was then noodled and washed for several hours. The washed noodles were combined, remelted, and chill set again to yield about 840 g of slurry about 4.2% (by weight) in gelatin and MO8. Titania pigmented paper reflection base was subjected to a corona discharge treatment, and thereafter overcoated with a melt comprising equal weights of gelatin and MO8. This melt was prepared by combining at 50° C. about 842 g of the aforesaid gelatin/MO8 slurry, about 10.2 g of spreading surfactant (10% by weight Olin-10G), and about 158.6 g of distilled water. This melt was coated on the reflection base at a coverage of about 91.3 mL/m$^2$ to yield a mordant covered base with coverages of about 3.22 g/m$^2$ in both gelatin and MO8. This base material was dried and stored until used in coating multilayer test elements.

Coating of Photographic Elements

Three test photographic elements were coated (Coatings 1–3 for Examples 1–5) according to Layer Structure 1 as described in Table 8. The base with coated mordant layer (MO8 and gel) described above was first overcoated with an opacifying reflective layer comprising titania in the rutile form. This layer was overcoated with blue sensitized AgCl emulsions and coupler. Coupler M was coated (Coating 1) as an NS dispersion at a level of 537 mg/m$^2$, coupler C was coated (Coating 2) as an NS dispersion at a level of 623 mg/m$^2$, and coupler Y was coated (Coating 3) as an NS dispersion at a level of 567 mg/m$^2$. These coatings were overcoated with a barrier layer, as described below.

Coatings 4 and 5 (for Examples 6–9) were coated according to Layer Structure 2, as described in Table 9. These coatings were coated similarly to Coatings 1–3. An additional gelatin interlayer was coated intermediate the emulsion/coupler layer and the titania/reflective layer. A higher level of blue sensitive AgCl was coated, and the coupler M was coated using dispersions 1:½ in coupler N,N-diethyl dodecanamide. The coupler dispersion used in Coating 4 was prepared using a colloid mill; the coupler dispersion in Coating 5 was prepared using a microfluidizer device. These coatings were overcoated with a barrier layer, as described below.

Coating 6 (Example 10) was prepared according to Layer Structure 3 (depicted in Table 10). This coating was prepared identically to Coating 4, except that an opaque layer of carbon black was coated intermediate the AgCl/coupler layer and the reflective titania layer. Coating 7 (Example 11) was prepared identically to Coating 6, except that the carbon black layer was omitted, and the titania pigment in the reflective layer was replaced with a hollow-sphere latex pigment (see Layer Structure 4 in Table 11). Ropaque® HP-91 (Rohm and Haas). These coatings were overcoated with a barrier layer, as described below.

TABLE 8

| Layer Structure 1 |
|---|
| VMX (966 mg/m$^2$) |
| gel (Type IV; 107 mg/m$^2$) |
| Coupler (537–623 mg/m$^2$) |
| Blue Sensitized AgCl (430 mg Ag/m$^2$ as AgCl) |
| gel (Type IV; 1.61 g/m$^2$) |
| $TiO_2$ (16.1 g/m$^2$) |
| gel (Type IV; 2.47 g/m$^2$) |
| MO8 (3.22 g/m$^2$) |
| gel (Type V; 3.22 g/m$^2$) |
| Transparent Base |

TABLE 9

| Layer Structure 2 |
|---|
| VMX (966 mg/m$^2$) |
| gel (Type IV; 107 mg/m$^2$) |
| Coupler (537 mg/m$^2$) |
| Blue Sensitized AgCl (752 mg Ag/m$^2$ as AgCl) |
| gel (Type IV; 1.61 g/m$^2$) |
| gel (Type IV; 2.15 g/m$^2$) |
| $TiO_2$ (16.1 g/m$^2$) |
| gel (Type IV; 2.47 g/m$^2$) |
| MO8 (3.22 g/m$^2$) |
| gel (Type V; 3.22 g/m$^2$) |
| Transparent Base |

TABLE 10

| Layer Structure 3 |
|---|
| VMX (966 mg/m$^2$) |
| gel (Type IV; 107 mg/m$^2$) |
| Coupler (537 mg/m$^2$) |
| Blue Sensitized AgCl (752 mg Ag/m$^2$ as AgCl) |
| gel (Type IV; 1.61 g/m$^2$) |
| carbon black (2.15 g/m$^2$) |
| gel (Type IV; 2.15 g/m$^2$) |
| $TiO_2$ (1.61 g/m$^2$) |
| gel (Type IV; 2.47 g/m$^2$) |
| MO8 (3.22 g/m$^2$) |
| gel (Type V; 3.22 g/m$^2$) |
| Transparent Base |

TABLE 11

| Layer Structure 4 |
|---|
| VMX (966 mg/m$^2$) |
| gel (Type IV; 107 mg/m$^2$) |
| Coupler (537 mg/m$^2$) |
| Blue Sensitized AgCl (752 mg Ag/m$^2$ as AgCl) |
| gel (Type IV; 1.61 g/m$^2$) |
| Ropaque HP-91 (3.22 g/m$^2$) |
| gel (Type IV; 2.15 g/m$^2$) |
| MO8 (3.22 g/m$^2$) |
| gel (Type V; 3.22 g/m$^2$) |
| Transparent Base |

Barrier Layer

Melts for coating the barrier layer were prepared by combining, at 50° C., 5% (by weight) aqueous VMX, 12.5% (by weight) aqueous gelatin, 10% (by weight) aqueous Olin 10G, Zonyl FSN, 1.8% (by weight) aqueous hardener (1,1'-[methylene bis(sulfonyl)]bis-ethene), and distilled water. The Olin 10G solution was typically added at a level corresponding to about 0.78% (by weight) of the total melt weight. The Zonyl FSN was added at a level corresponding to about 10% of the weight of aqueous Olin 10G solution added. Hardener was typically added at a level corresponding to about 1.5% by weight of the total gelatin coated in the respective multilayer coating. Such melts were used to overcoated the coupler/mordant/base coatings at coverages typically of about 54 mL/m$^2$ to yield about 966 mg VMX/m$^2$ and about 107 mg gelatin/m$^2$.

Processing and Sensitometry

These test coatings were exposed for 0.01 s to a tungsten light source 2850° K.) through a 0–3 density 21-step tablet and developed according to hot or cold processing procedures. This hot process comprised development for 45 sec in a large volume of developer solution, rinsing in a large volume of pH 4 buffer for 60 sec, washing in water for 90 sec, all at 35° C., and drying in a hot air dryer. This cold process comprised development at 20° C. for 180 sec in a large volume of developer solution, rinsing at 20° C. in a large volume of pH 4 buffer for 120 sec, washing in water for 90 sec at 40° C., and drying in a hot air dryer. The developer solution was prepared according to the following composition:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH = 10.04 @ 27° C. | |

The test coatings, each approximately 35 mm×305 mm in dimension, were immersed in large volume (approximately 9 L) processing tanks in each of the development, stop, and wash steps. Reflection dye densities in the Dmax region of the dye receiver were then read through the transparent support with a Macbeth densitometer using status-A filters. These Dmax values are listed below in Table 12 for Examples 1–11, and illustrate that suitable Dmax are obtained in the elements of this invention.

TABLE 12

| Example | Coating | Layer Structure | Coupler | Process | Dmax |
|---|---|---|---|---|---|
| 1 | 1 | 1 | M | cold | 1.92 |
| 2 | 2 | 1 | C | cold | 1.79 |
| 3 | 1 | 1 | M | hot | 2.53 |
| 4 | 2 | 1 | C | hot | 1.84 |
| 5 | 3 | 1 | Y | hot | 1.52 |
| 6 | 4 | 2 | M | cold | 1.32 |
| 7 | 5 | 2 | M | cold | 1.41 |
| 8 | 4 | 2 | M | hot | 1.63 |
| 9 | 5 | 2 | M | hot | 1.87 |
| 10 | 6 | 3 | M | hot | 1.51 |
| 11 | 7 | 4 | M | hot | 2.43 |

This invention has been described in detail with particular reference to preferred embodiments thereof, but it will be understood that variations and modifications can be effected within the spirit and scope of the invention.

What is claimed is:

1. A photographic color diffusion transfer element comprising one and only one dimensionally stable support and coated thereon in reactive association and in sequence (1) a mordant layer for binding diffusible dyes, (2) a light reflecting layer, (3) imaging layers comprising a radiation sensitive layer comprising silver halide and a diffusible dye forming layer comprising a diffusible dye forming compound, and (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound.

2. A photographic color diffusion transfer element comprising one and only one dimensionally stable support and coated thereon in reactive association and in sequence (1) imaging layers comprising a radiation sensitive layer comprising silver halide and a diffusible dye forming layer comprising a diffusible dye forming compound, (2) a light reflecting layer, (3) a mordant layer for binding diffusible dyes, and (4) a barrier layer comprising a polymer that allows the passage of solutions for processing said element when said element is contacted with an external processing bath, and wherein said barrier layer impedes the diffusion out of said element of the diffusible dye formed from said diffusible dye forming compound.

3. An element as described in claims 1 or 2, wherein said element further comprises a layer coated on the side of the support opposite the mordant layer.

4. An element as described in claims 1 or 2, wherein said mordant layer comprises an ultraviolet filter dye.

5. An element as described in claims 1 or 2, with the proviso that said external bath comprises a volume greater than 20 mL per square meter of element in contact with said bath.

6. An element as described in claims 1 or 2, with the proviso that said external bath comprises a volume greater than 200 mL per square meter of element in contact with said bath.

7. An element as described in claims 1 or 2, wherein said mordant layer comprises mordant polymer.

8. An element as described in claims 1 or 2, wherein said mordant layer comprises polymer comprising vinyl monomer units having tertiary amino groups or quaternary ammonium groups and wherein said vinyl monomer units are selected from the group consisting of:

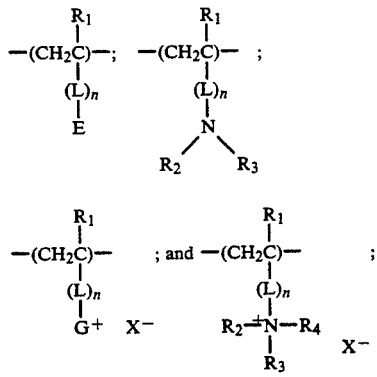

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quaternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

9. An element as described in claims 1 or 2, wherein said mordant comprises polymer selected from the group consisting of:

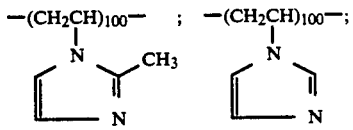
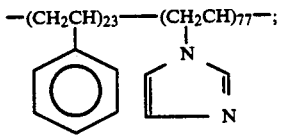
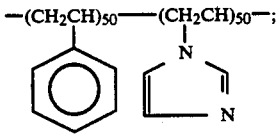
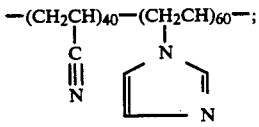
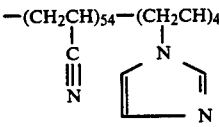
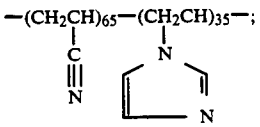
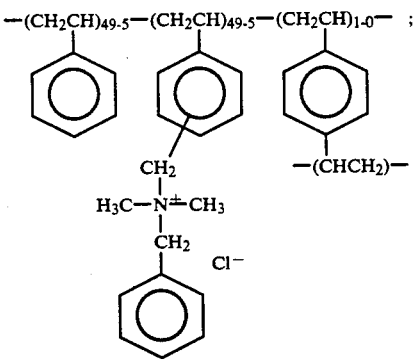
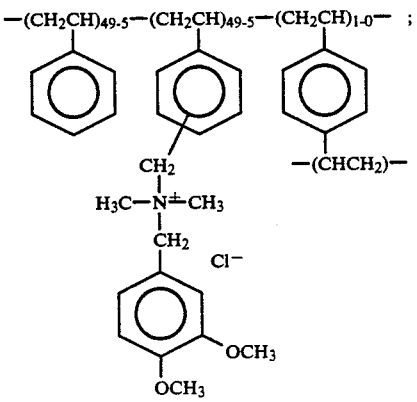
-continued
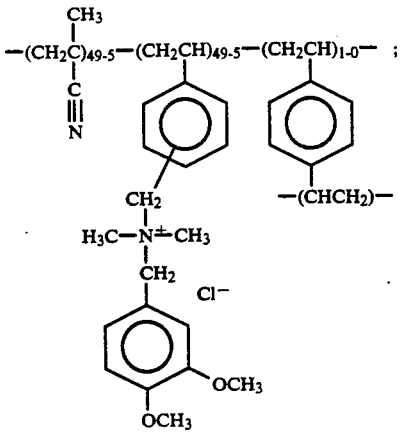
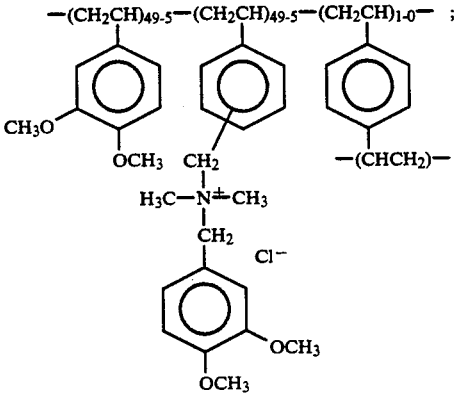
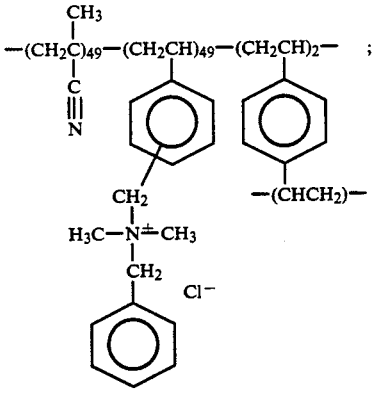
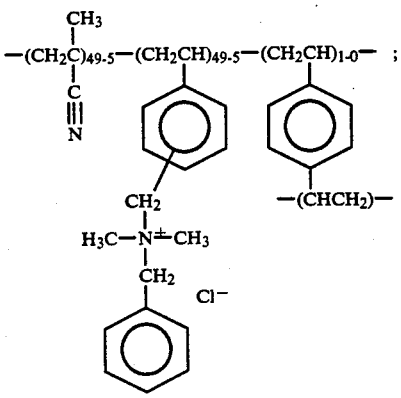

-continued
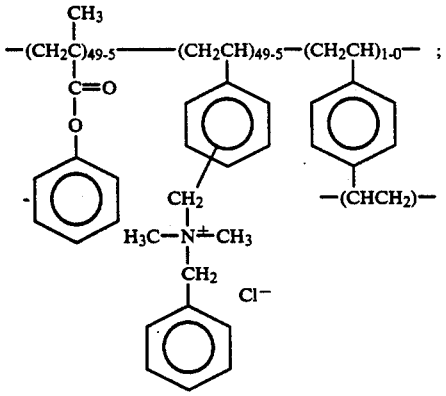
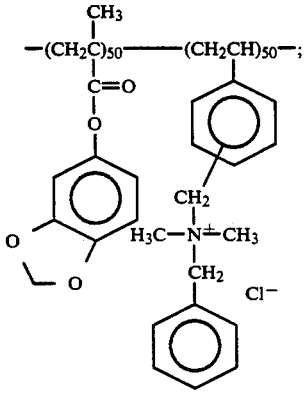
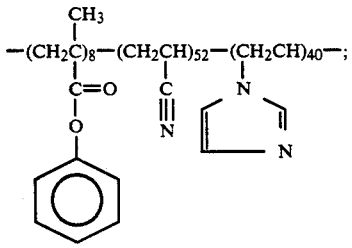
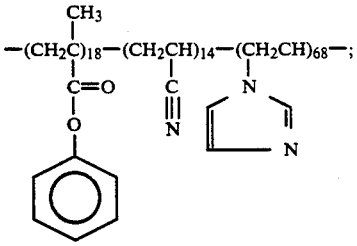
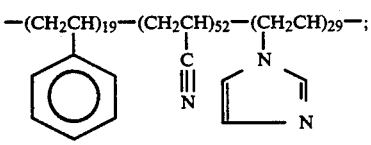
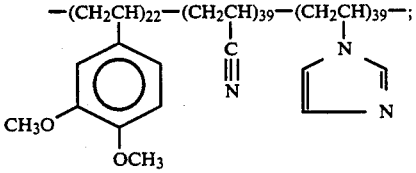
-continued
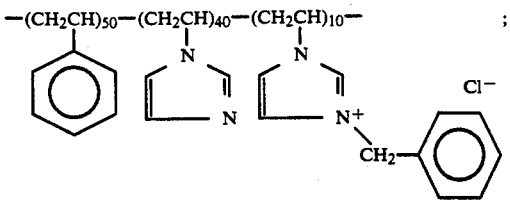
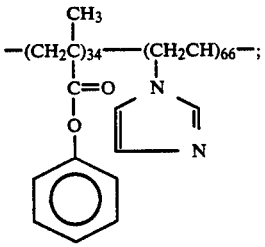
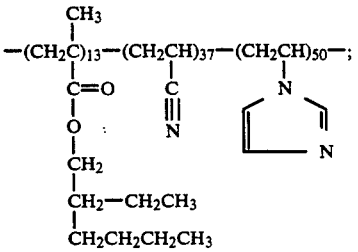
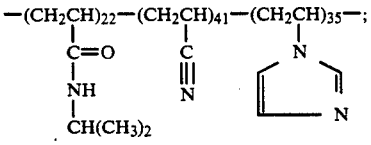
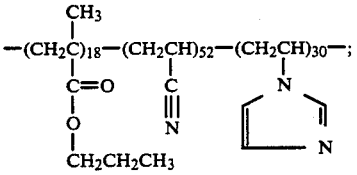
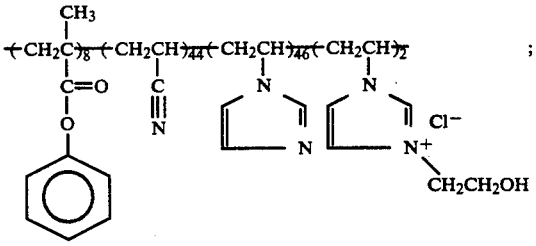
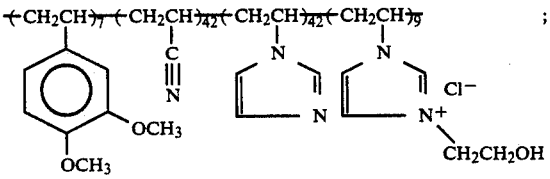

-continued

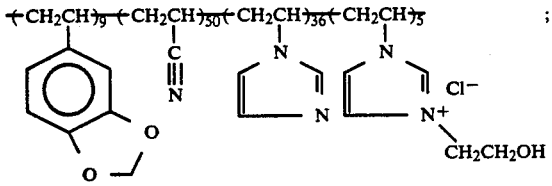

;

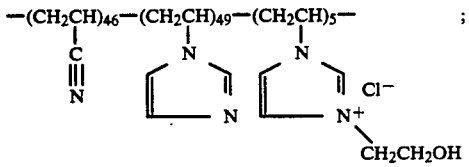

;

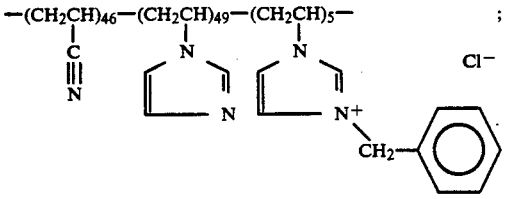

;

and wherein repeating-unit subscripts indicate weight percents of the respective repeating units and the chloride counter ion may be replaced with any monovalent anion.

10. An element as described in claims 1 or 2, wherein said mordant layer comprises mordant polymer at a coverage of 0.2–15 g/m$^2$.

11. An element as described in claims 1 or 2, wherein said mordant layer comprises mordant polymer at a coverage of 0.5–8 g/m$^2$.

12. An element as described in claims 1 or 2, wherein said mordant layer comprises mordant polymer with molecular weight in the range of 1,000–1,000,000.

13. An element as described in claims 1 or 2, wherein said mordant layer comprises mordant polymer with molecular weight in the range of 10,000–200,000.

14. An element as described in claims 1 or 2, wherein said mordant layer comprises hydrophilic binder.

15. An element as described in claim 14, wherein said hydrophilic binder is gelatin.

16. An element as described in claims 1 or 2, wherein said mordant layer comprises mordant polymer and hydrophilic binder at a weight-ratio of mordant polymer to hydrophilic binder in the range of 1:5 to 5:1.

17. An element as described in claims 1 or 2, wherein the barrier layer comprises a polymer containing from about $1\times10^{-5}$ to about $4\times10^{-3}$ moles/gram of ion forming functional groups such that the barrier layer constrains diffusible dye and allows the passage of processing solutions for processing the silver halide emulsion layer.

18. An element as described in claim 17, wherein the polymer is comprised of repeating units derived from ethylenically unsaturated monomers.

19. An element as described in claim 18, wherein the polymer is comprised of repeating units derived from a hydrophobic acrylate, methacrylate, acrylamide or methacrylamide monomer.

20. An element as described in claim 19, wherein the polymer is further comprised of repeating units derived from a nonionic hydrophilic ethylenically unsaturated monomer.

21. An element as described in claim 19, wherein the polymer comprises repeating units of the formula $$-(A)_m-(B)_n-$$

wherein

A is a hydrophobic monomer yielding the repeating unit

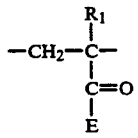

where $R_1$ is hydrogen or methyl;

E is $-OR_2$ or $-NR_3R_4$ $R_2$ is a substituted or unsubstituted straight, branched, or cyclic alkyl or aryl group of 1 to 10 carbon atoms;

$R_3$ and $R_4$ are independently selected from hydrogen or any $R_2$ group; and $R_3$ and $R_4$ together contain at least 3 carbon atoms;

m is 0 to 99.5 mole percent;

wherein

B is an ionic hydrophilic monomer yielding the repeating unit

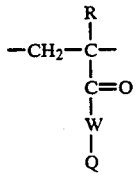

where

R is hydrogen or methyl;

W is $-OR_5$ or $-NR_6R_7$;

$R_5$ is a straight, branched, or cyclic alkylene or arylene group of 1 to 10 carbon atoms;

$R_6$ is hydrogen or a straight, branched, or cyclic alkyl or aryl group from 1 to 6 carbon atoms;

$R_7$ is a straight, branched or cyclic alkylene or arylene group of 1 to 10 carbon atoms;

n is 0.5 to 100 mole percent;

Q is an ionic functional group independently selected from:

(a) $-NH_2$ or the acid addition salt $-NH_2$:HX, where X is an appropriate acid anion or (b) $-CO_2M$, $-SO_2M$, $-OSO_3M$, $-OPO_3M$ and $-OM$ where M is an appropriate cation.

22. An element as described in claims 1 or 2, wherein said barrier layer comprises a polymer coated at a level of 100 mg/m$^2$ to 10 g/m$^2$.

23. An element as described in claims 1 or 2, wherein said barrier layer comprises a polymer coated at a level of 750 mg/m$^2$ to 2 g/m$^2$.

24. An element as described in claim 21, wherein the said polymer is selected from the group consisting of:

$(IPA)_{90}(APM)_{10}$;

$(IPA)_{92}(APM)_{8}$;

$(IPA)_{85}(A)_{10}(APM)_5$;

$(TBA)_{75}(APM)_{25}$;

$(TBA)_{80}(APM)_{20}$;

$(TBA)_{83}(APM)_{17}$;

$(TBA)_{84}(APM)_{16}$;

$(NBA)_{80}(APM)_{20}$;

$(TBMA)_{80}(APM)_{20}$;

$(TBA)_{65}(IPA)_{20}(APM)_{15}$;

$(DOA)_{80}(APM)_{20}$;

$(TBA)_{60}(DOA)_{20}(APM)_{20}$;

$(TBA)_{75}(A)_{20}(SSA)_5$;

$(TBA)_{76}(CEA)_8(APM)_{16}$;

$(TBA)_{65}(A_{20}(CEA)_5(APM)_{10}$;

$(TBA)_{65}(A)_{20}(SSA)_5(APM)_{10}$;

where the subscript indicate mole percents, and of:

$(IPA)_{80}(MBA)_{10}(APM)_{10}$;

$(NBM)_{50}(AEM)_{15}(HEM)_{35}$;

$(NBM)_{50}(AEM)_{30}(HEM)_{20}$;

$(NBM)_{40}(AEM)_{25}(HEM)_{35}$;

$(NBM)_{26}(AEM)_{22}(HEM)_{52}$;

$(NBM)_{20}(AEM)_{15}(HEM)_{65}$;

$(NBM)_{60}(SEM)_5(AAM)_{10}(HEM)_{25}$;

$(NBM)_{70}(SEM)_{2.5}(AAM)_{10}(HEM)_{17.5}$;

$(BZM)_{50}(SEM)_{2.5}(AAM)_{10}(HEM)_{37.5}$;

$(2EHM)_{50}(SEM)_5(AAM)_{10}(HEM)_{35}$;

$(NEM)_{50}(SEM)_5(AAM)_{10}(HEM)_{35}$;

$(BZM)_{60}(SEM)_{2.5}(AAM)_{10}(HEM)_{27.5}$;

where the subscripts indicate weight percents, and where IPA is N-isopropylacrylamide, TBA is N-t-butylacrylamide, NBA is N-butylacrylamide, TBMA is N-t-butylmethacrylamide, DOA is N-(1,1-dimethyl-3-oxobutyl)acrylamide, NBM is N-butylmethacrylate, 2EHM is 2-ethyl-hexylmethacrylate, BZM is benzylmethacrylate, AAM is 2-acetoacetoxyethylmethacrylate; a crosslinker, A is acrylamide, HEM is hydroxyethylmethacrylate, MBA is methylene-bis-acrylamide (difunctional), APM is N-(3-aminopropyl)methacrylamide hydrochloride, AEM is aminoethylmethacrylate hydrochloride, SEM is sulfoethylmethacrylate sodium salt, SSA is N-(2-sulfo-1,1-dimethylethyl)acrylamide sodium salt, and CEA is N-2-carboxyethylacrylamide.

25. An element as described in claims 1 or 2, wherein the diffusible dye forming compound is a coupler molecule selected from the group consisting of Dye-Y-Cp-D-B wherein:

Dye is a dye radical exhibiting selective absorption in the visible spectrum and contains an acidic solubilizing group;

Y is a linking radical selected from the group consisting of an azo radical, a mercuri radical, an oxy radical, a thio radical, a dithio radical, and an azoxy radical;

Cp is a coupler radical selected from the group consisting of a 5-pyrazolone coupler radical, a phenolic coupler radical, and an open chain ketomethylene coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

B is a photographically inert organic ballasting radical of such molecular size and configuration as to render said couplers nondiffusible during development in alkaline color developing solution.

26. An element as described in claims 1 or 2, wherein the diffusible dye forming compound is a coupler molecule selected from the group consisting of B-Y-Cp-D-R wherein:

B is a photographically inert organic ballasting radical of such molecular size and configuration as to render said couplers nondiffusible during development in an alkaline solution of color developing agent;

Y is a linking radical selected from the group consisting of an azo radical, a mercuri radical, an oxy radical, an alkylidene radical, a thio radical, a dithio radical, and an azoxy radical;

Cp is a coupler radical selected from the group consisting of a 5-pyrazolone coupler radical, a phenolic coupler radical, and an open chain ketomethylene coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

R is selected from the group consisting of a hydrogen atom and an acidic solubilizing group when said color developing agent contains an acidic solubilizing group, and R is an acidic solubilizing group when said color developing agent is free of an acidic solubilizing group.

27. An element as described in claims 1 or 2, wherein the diffusible dye forming compound is a molecule selected from the group consisting of

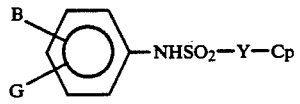

wherein:

B is a photographically inert organic ballasting radical of such molecular size and configuration as to render said couplers nondiffusible during development in an alkaline color developing solution;

G is an —OR or —$NR_1R_2$ radical wherein R is hydrogen or a hydrolyzable moiety and $R_1$ and $R_2$ are each hydrogen or an alkyl group;

Y is a linking radical selected from the group consisting of an azo radical, a mercuri radical, an oxy radical, an alkylidene radical, a thio radical, a dithio radical, and an azoxy radical;

Cp is a coupler radical substituted in the coupling position with said Y linking group, a diffusible dye radical, or a diffusible dye precursor.

28. An element as described in claims 1 or 2, wherein the diffusible dye forming compound is a molecule selected from the group consisting of

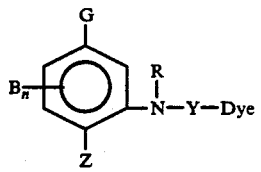

wherein:

$B_n$ is one or more photographically inert organic ballasting radicals of such molecular size and configuration as to render said molecule nondiffusible during development in alkaline color developing solution;

G is an —OR′ or —$NR_1R_2$ radical wherein R′ is hydrogen or a hydrolyzable moiety and $R_1$ and $R_2$ are each hydrogen or an alkyl group;

Z is hydrogen or is selected from the group consisting of radicals replaceable by oxidized aromatic amino color developer;

R is hydrogen, alkyl, or substituted alkyl;

Y is a divalent linking radical selected from the group consisting of an azo radical, a mercuri radical, an oxy radical, an alkylidene radical, a thio radical, a dithio radical, and an azoxy radical;

Dye is a dye radical or dye precursor.

29. An element as described in claims 1 or 2, wherein the diffusible dye forming compound is a molecule selected from the group consisting of

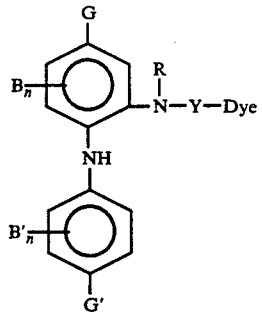

wherein:

$B_n$ and $B'_n$ each represent a photographically inert organic ballasting radicals of such molecular size and configuration as to render said molecule nondiffusible during development in alkaline color developing solution;

G and G′ each is hydrogen, hydroxy, —OR′, or —$NR_1R_2$ radical wherein R′ is a hydrolyzable moiety and $R_1$ and $R_2$ are each hydrogen or an alkyl group provided at least one of G and G′ is hydroxy or amino;

R is hydrogen, alkyl, or substituted alkyl;

Y is a divalent linking radical selected from the group consisting of an azo radical, a mercuri radical, an oxy radical, an alkylidene radical, a thio radical, a dithio radical, and an azoxy radical;

Dye is a dye radical or dye precursor.

30. An element as described in claims 1 or 2, wherein said dimensionally stable support is transparent.

31. A photographic color diffusion transfer element comprising one and only one dimensionally stable support and coated thereon in reactive association and in sequence (1) a mordant layer for binding diffusible dyes, (2) a light reflecting layer, (3) imaging layers comprising a radiation sensitive layer comprising silver halide and a diffusible dye forming layer comprising a diffusible dye forming compound, and (4) a barrier layer comprising a polymer that allows the passage of solutions for processing said element when said element is contacted with an external processing bath, and wherein said barrier layer prevents diffusible dye from passing, wherein said polymer of said barrier layer contains from $1\times10^{-5}$ to $4\times10^{-3}$ moles/gram of ion forming functional groups such that said barrier layer deflects diffusible dye, comprises repeating units derived from ethylenically unsaturated monomers, wherein said polymer of said barrier layer does not contain secondary, tertiary, or quaternary ammonium groups, wherein said monomers comprise monomers derived from hydrophobic acrylate, methacrylate, acrylamide, or methacrylamide monomers, and wherein the volume of said external processing bath is greater than 200 mL per square meter of said element in contact with said external bath.

32. A photographic color diffusion transfer element comprising one and only one dimensionally stable support and coated thereon in reactive association and in sequence (1) imaging layers comprising a radiation sensitive layer comprising silver halide and a diffusible dye forming layer comprising a diffusible dye forming compound, (2) a light reflecting layer, (3) a mordant layer for binding diffusible dyes, and (4) a barrier layer comprising a polymer that allows the passage of solutions for processing said element when said element is contacted with an external processing bath, and wherein said barrier layer prevents diffusible dye from passing, wherein said polymer of said barrier layer contains from $1\times10^{-5}$ to $4\times10^{-3}$ moles/gram of ion forming functional groups such that said barrier layer deflects diffusible dye, comprises repeating units derived from ethylenically unsaturated monomers, wherein said polymer of said barrier layer does not contain secondary, tertiary, or quaternary ammonium groups, wherein said monomers comprise monomers derived from hydrophobic acrylate, methacrylate, acrylamide, or methacrylamide monomers, and wherein the volume of said external processing bath is greater than 200 mL per square meter of said element in contact with said external bath.

* * * * *